US006078760A

United States Patent [19]

Abe et al.

[11] Patent Number: 6,078,760

[45] Date of Patent: Jun. 20, 2000

[54] IMAGE FORMING APPARATUS HAVING AN INVERSE AND RE-FIXING SUB-MODE

[75] Inventors: Nobumasa Abe; Kaneo Yoda; Takayuki Shiraki; Tahei Ishiwatari; Kazutoshi Fujisawa; Naoyuki Okumura; Kenjiro Yoshioka; Hiroshi Tanaka, all of Nagano, Japan

[73] Assignee: Seiko Epson Corporation, Tokyo, Japan

[21] Appl. No.: 09/114,167

[22] Filed: Jul. 13, 1998

[30] Foreign Application Priority Data

| | | | |
|---|---|---|---|
| Jul. 14, 1997 | [JP] | Japan | 9-203850 |
| Jul. 14, 1997 | [JP] | Japan | 9-203851 |
| Sep. 30, 1997 | [JP] | Japan | 9-282810 |
| Sep. 30, 1997 | [JP] | Japan | 9-282811 |
| Sep. 30, 1997 | [JP] | Japan | 9-282812 |
| Sep. 30, 1997 | [JP] | Japan | 9-282813 |
| Sep. 30, 1997 | [JP] | Japan | 9-282814 |

[51] Int. Cl.[7] ..... G03G 15/20

[52] U.S. Cl. ..... 399/45; 399/68; 399/82; 399/322; 399/328

[58] Field of Search ..... 399/82, 85, 320, 399/321, 322, 328, 45, 68

[56] References Cited

U.S. PATENT DOCUMENTS

| | | | |
|---|---|---|---|
| 4,777,498 | 10/1988 | Kasamura et al. | 399/401 |
| 5,581,339 | 12/1996 | Jamzadeh et al. | 399/320 |

FOREIGN PATENT DOCUMENTS

| | | |
|---|---|---|
| 6-1394 | 9/1985 | Japan . |
| 61-11865 | 4/1986 | Japan . |
| 4-344680 | 12/1992 | Japan . |
| 5-119649 | 5/1993 | Japan . |
| 5-48917 | 7/1993 | Japan . |
| 5-289468 | 11/1993 | Japan . |
| 6-40235 | 5/1994 | Japan . |
| 6-68646 | 8/1994 | Japan . |
| 8-220904 | 8/1996 | Japan . |

*Primary Examiner*—Joan Pendegrass
*Attorney, Agent, or Firm*—Sughrue, Mion, Zinn, Macpeak & Seas, PLLC

[57] ABSTRACT

An image forming apparatus which is able to form either single or double sided copies on a recording medium while achieving an excellent image quality in either a matted or glossy finish. The image forming apparatus includes a fixing portion in which a first roller includes a first temperature and hardness for forming a matted image, whereas a second roller includes a higher temperature and hardness for forming a glossy image. Alternatively, or in addition, to different hardness and temperatures, the recording medium can be conveyed at a first speed to form a matted image, and a slower speed to form a glossy image. The image forming apparatus further includes an inverse and re-fixing sub-mode, which utilizes an inverting and returning passage, for reducing the curl in a recording medium, and thus also reducing the instances in which clogging takes place. The inverting and returning passage has a length sufficient to accommodate a plurality of recording mediums. Moreover, the image forming apparatus is provided with first and second discharge passages so that if one passage is clogged, the other can be used to discharge recording mediums. A switching means selects, based on detection sensors, through which discharge passage a recording medium is fed. The operations of the image forming apparatus are coordinated by a control unit.

26 Claims, 9 Drawing Sheets

IMAGE FORMING APPARATUS HAVING AN INVERSE AND RE-FIXING SUB-MODE

BACKGROUND OF THE INVENTION

1. Field of the Invention

The present invention relates to an image forming apparatus for forming an image (including characters and the like) on a recording medium (plain paper, coat paper, an OHP (Over Head Projector) sheet, glossy paper, a glossy film, a color-image-only paper, a cut sheet, such as a postcard or an envelope) after which the image is fixed and discharged. The present invention relates to an image forming apparatus, such as a printer, a facsimile machine, a copying machine or the like, for mainly using an electrophotographic technology to form a color image on a recording medium, fix the color image and discharge the recording medium. More particularly the present invention relates to a fixing technology for use in the image forming apparatus capable of forming either matte or glossy images on two sides of a recording medium. Further, the present invention relates to a paper discharge passage of the image forming apparatus.

The present application is based on Japanese Patent Application Nos. Hei. 9-203850, Hei. 9-203851, Hei. 9-282810, Hei. 9-282811, Hei. 9-282812, Hei. 9-282813, Hei. 9-282814 which are incorporated herein by reference.

2. Description of the Related Art

In general, image forming apparatuses have widely been known which incorporate a fixing unit for conveying a recording medium while heating and applying pressure to the recording medium. The apparatus is arranged such that a non-fixed image formed by a developer, such as toner, is formed on the surface of the recording medium after which the recording medium is allowed to pass through a fixing unit having a pair of rollers so that an image is fixed to the recording medium.

Devices for use with an image forming apparatus of the above-mentioned type have been known, for example, as in Japanese Patent Publication No. 5-48917 and Japanese Patent Publication No. 6-68646. These devices attempted to improve the fixing characteristic by selectively (as necessary) allowing a recording medium to pass through a fixing unit two times.

One of the two types of the image forming apparatuses which has been disclosed in Japanese Patent Publication No. 6-68646 has a double-side mode for forming images on two sides of a recording medium and a single-side mode for forming an image on either side of the recording medium. When a glossy image is formed on an OHP film in the single-side mode, the OHP film is allowed to pass through the fixing unit two times. Thus, a glossy image can be obtained.

Specifically, the apparatus disclosed in Japanese Patent Publication No. 6-68646 has a structure in which a plurality of recording mediums, on which images are formed on one side, are temporarily accumulated in an intermediate tray so that images can be formed on both sides of the recording medium, in the double-side mode. Each recording medium is again supplied from the intermediate tray to the image forming portion so as to form an image on the other side. Thus, images are formed on both sides of each recording medium. However, when a glossy image is formed on an OHP film, a plurality of the OHP films are temporarily accumulated in the intermediate tray. Then, each OHP film is again fed to the fixing unit from the intermediate tray. But, when a plurality of OHP films are stacked and accumulated in the intermediate tray, the OHP films easily adhere to one another. Because the OHP films easily adhere to one another, there arises a clogging problem in the feeding operation, or undesirable stacking easily takes place.

Further, when a separating agent is applied to the fixing roller, in Japanese Publication No. 6-68646, the separating agent adheres to the surface of the recording medium. Since the recording medium in the form of a resin sheet, such as an OHP sheet, has a poor oil absorbing characteristic, the OHP sheets furthermore easily adhere to one another when the OHP sheets are stacked on the intermediate tray. Thus, problems easily arise in the feeding operation, or stacking easily takes place. Also, since a space for the paper feeding tray is required, there arises another problem in that the size of the apparatus cannot be reduced.

When a color image is formed, toner images in a plurality of colors (for example, yellow, magenta, cyan and black) superimposed on the recording medium must be melted and fixed. Since a great heat capacity is required, a known fixing unit is structured such that a recording medium is allowed to pass through the fixing unit at relatively low speed. See for example, Japanese Patent Publication No. 6-40235.

An image forming apparatus capable of forming images on two sides of paper sheets, a two-side copying machine as disclosed in Japanese Patent Publication No. 61-11865, for example, has been known.

As shown in FIG. 9(*a*), a typical double-side copying machine has a structure that an original document 1 is irradiated with a lamp 2. Reflected light is imaged on a photosensitive drum 3 so that an electrostatic latent image is formed on the photosensitive drum 3. The electrostatic latent image is visualized into a powder image or the like by a developing unit 4 so as to be transferred to copying paper 7 fed from paper feeders 5 and 6. The powder image is then fixed to the copying paper 7 by a fixing unit 8. The copying paper 7 is allowed to pass through a passage 9, and is then moved to a right-side/reverse-side converting unit 10. If a single-side final copy is desired, the copying paper 7 is allowed to pass through a paper-discharge passage 11 and a def lector 12. The copying paper 7 is then discharged to the upper surface of a paper-discharge tray 13 disposed on the body of the apparatus.

If a double-side final copy is desired, the copying paper 7 having a powder image formed by the fixing unit 8 is allowed to pass through the passage 9, and is then moved to the right-side/reverse-side converting unit 10. After the leading end of the copying paper 7 has temporarily been introduced into the paper-discharge passage 11, the copying paper 7 is moved inversely such that the copying paper 7 is allowed to pass through an inverse passage 14. Thus, the copying paper 7 is stacked and accommodated in an accommodating portion 15. The operation for stacking copying paper in the accommodating portion 15 continues until images are copied on one side of a predetermined number of paper sheets.

After the operation for copying one side of all of the copying paper sheets has been completed, the copying paper 7 stacked in the accommodating portion 15 is allowed to pass through a re-feeding passage 17 by a paper-supply roller 16 so as to again be moved to the photosensitive drum 3. A powder image is then formed on the other side, after which the copying paper 7 passes through the fixing unit 8 as well as the right-side/reverse-side converting unit 10 and is moved to the paper-discharge passage 11.

FIG. 9(*b*) is a diagram showing an example of the right-side/reverse-side converting unit described above. The right-side/reverse-side converting unit has a drive roller 18 and conveying rollers 19, 20 disposed at the inlet and outlet portions thereof. A drive roller 21 and a movable roller 22 are disposed in the rear of the right-side/reverse-side converting unit. A deflecting plate 23 is disposed between the drive roller 18 and the drive roller 21. The deflecting plate 23 is rotatively supported by a shaft 23*a* such that the deflecting plate 23 is always urged clockwise by a spring (not shown).

The operation of the right-side/reverse-side converting unit will now be described.

(i) When the copying paper 7 moved from the fixing unit 8 through the passage 9 is moved to the paper-discharge passage 11, all of the rollers are rotated in a direction (forward direction) indicated by an arrow shown in the drawing. Thus, the copying paper 7 discharged from the fixing unit 8 is moved to the paper-discharge passage 11 by the drive roller 18, the conveying roller 19, the drive roller 21 and the movable roller 22.

(ii) When passage of the trailing end 7*a*2 of the copying paper 7*a* moved in the forward direction through the leading end of the deflecting plate 23 has been detected by the detecting portion 24, the drive roller 21 and the movable roller 22 disposed in the rear of the detecting portion 24 are reversely rotated. The trailing end 7*a*2 of the copying paper 7*a* is guided by the deflecting plate 23 so as to be introduced into a position between the drive roller 18 and the conveying roller 20.

(iii) When the trailing end 7*a*2 of the copying paper 7*a* is detected by detecting portion 25, thereby indicating that the copying paper 7 has reached a position between the drive roller 18 and the conveying roller 20, the movable roller 22 is moved upwards to separate it from drive roller 21.

Once a space is formed between the drive roller 21 and the movable roller 22, the next copying paper 7*b* is conveyed to the paper-discharge passage 11 by the drive roller 18 and the conveying roller 19. At this time, a leading end 7*b*1 of the next copying paper 7*b* is guided by the upper surface of the preceding copying paper 7*a*.

(iv) When the leading end 7*a*1 of the preceding copying paper 7*a* has been allowed to pass through the 201 position between the drive roller 21 and the movable roller 22, the movable roller 22 is moved downwards. Moreover, the drive roller 21 is rotated forward so that the next copying paper 7*b* is conveyed until the trailing end 7*b*2 of the copying paper 7*b* is allowed to pass through the detecting portion 24.

The above-mentioned operation is then repeated as necessary.

After the image has been formed on either one or both sides of a paper sheet, it must be discharged from the apparatus. An image forming apparatus therefore not only incorporates an image forming portion, but also incorporates a paper supply portion, a paper discharge passage and a receiving portion. The paper supply portion may include a paper feeding cassette or a paper supply tray, for supplying paper sheets to the image forming portion. The paper discharge passage discharges the paper sheet on which an image has been formed by the image forming portion. The receiving portion, such as a paper discharge tray, receives the paper sheet discharged from the paper discharge passage.

In a typical apparatus, a paper-sheet conveying passage (including the paper discharge passage) is formed from the paper supply portion to the receiving portion through the image forming portion. The paper sheet is sometimes clogged in the paper-sheet conveying passage.

If paper sheets are still conveyed after one paper sheet has been clogged, the clogging is exacerbated. The clog may be exacerbated to the point where there is a risk of breaking the apparatus. Therefore, an apparatus of the foregoing type is usually provided with a detection means for detecting clogging of a paper sheet. If the detection means detects clogging of a paper sheet, the operation of the apparatus is interrupted. Moreover, a message (alarm sound and/or display on a display portion of an operation panel) indicates occurrence of clogging to a user. Then, the apparatus awaits removal of the clogged paper sheet, whereupon the apparatus again becomes operational.

Some apparatuses are capable of forming images at high speed. These image forming apparatuses mainly use electrophotographic technology and sometimes encounter continued conveyance of paper sheets in the conveying passage even when a paper sheet is clogged therein. In this case, the user is undersirably caused to remove paper sheets which are not clogged. Removal of the sheets which are not clogged is a demanding task.

To overcome the problem of requiring a user to remove the sheets which are not clogged, a copying machine has been suggested in Examined Japanese Patent Publication Open No. 6-1394. There, a drive mechanism of a conveying system is started to discharge the paper sheets, which are not clogged, to a tray. The discharge of sheets occurs after clogging has taken place and a copy start button is again depressed.

<Problem 1>

In a conventional image forming apparatus, a recording medium allowed to pass through a fixing unit is undesirably curled.

The conventional image forming apparatuses disclosed in Japanese Patent Publication No. 5-48917 and Japanese Patent Publication No. 6-68646 have a structure in which the recording medium is not turned inside out when the recording medium, having an image formed on one side thereof, is allowed to pass through the fixing unit two times. Therefore, curls of the recording medium are accumulated and enlarged, causing the recording medium to easily clog in the conveying passage. As noted above, a clogged conveying passage is undesirable.

In recent years, users have required an apparatus for fixing a matted image (delustered image) or a glossy image (a bright image) upon demand. A matted image is obtained by preventing complete melting of the toner image. A matted image can thus be obtained by fixing the matted image with a relatively small quantity of heat. A glossy image is obtained by completely melting the toner image. Therefore, a glossy image can be obtained by fixing the toner image with a relatively large quantity of heat.

The conventional technologies also encounter problems in meeting user requirements for both matted and glossy images as follows.

A first type of apparatus is structured such that the recording medium selectively passes through the fixing unit two times. Examples of the type of apparatus are disclosed in Japanese Patent Publication No. 5-48917 and Japanese Patent Publication No. 6-68646). This type of apparatus attempts to form a matted image by passing the recording medium, having a non-fixed image formed thereon, through the fixing unit only one time when a matted image is required. When a glossy image is required, this type of apparatus passes the recording medium through the fixing unit two times. However, in both cases, image (either matted or glossy) which is formed on the recording medium is brought into contact with only the same roller.

When a matted image having an excellent image quality is required, it is preferable that the surface of the image be somewhat rough by not completely melting the toner particles on the surface of the image. To cause a somewhat rough state in the toner particles, it is preferable that the surface layer of the roller, which is brought into contact with the surface of the image, have a relatively low hardness.

When a glossy image having an excellent image quality is required, it is preferable that the toner on the surface of the image be completely melted and smoothed. To smooth the surface of the toner it is preferable that the hardness of the surface layer of the roller, which is brought into contact with the surface of the image, have a relatively high hardness.

Thus it can be seen that the above-mentioned conventional technologies having a structure in which the image (either matted or glossy) formed on the recording medium is brought into contact with the same roller, cannot easily and selectively form a matted image and a glossy image. If the hardness of the surface layer of the roller is made to be relatively low, a glossy image having a satisfactory image quality cannot be obtained even though an excellent matted image can be obtained. Similarly, if the hardness of the surface layer of the roller is made to be relatively high, a matted image having an excellent image quality cannot be obtained even though a satisfactory glossy image can be obtained.

The above-mentioned problems are also experienced with the conventional technology disclosed in Japanese Patent Publication No. 6-40235. Thus, the conventional technologies based on one roller having a set hardness, cannot selectively form a matted image or a glossy image having an excellent image quality.

<Problem 2>

Apparatuses arranged such that the recording medium is allowed to selectively pass through the fixing unit two times are disclosed in Japanese Patent Publication No. 5-48917 and Japanese Patent Publication No. 6-68646. These apparatuses have a structure in which the recording medium is allowed to pass through the fixing unit one or two times under the same fixing condition (fixing pressure, fixing temperature and fixing speed). Therefore, a matted image or a glossy image cannot selectively be obtained.

If a fixing condition is set such that a matted image can be obtained in one pass, a glossy image cannot easily be obtained after the passing operation is performed two times under the same fixing condition. The reason is that heat is radiated from the recording medium and the toner image during the period between the first pass and the second pass. Although a glossy image can be obtained by performing the passing operation two or more times, there is risk that an excessively large number of times may be required to do so.

If the fixing condition is set such that a glossy image can be obtained by performing the passing operation, for example, two times, the quantity of heat is too much to obtain a matted image after the passing operation has been performed one time under the same fixing condition.

As can be understood from the foregoing description, the conventional technologies, based on the number of times a sheet is fed, cannot easily and selectively obtain a matted image or a glossy image.

Another conventional technology, disclosed in Japanese Patent Publication No. 6-40235, attempts to form a matted image by allowing a recording medium having a non-fixed image formed thereon to pass through a fixing unit at relatively high speed. When a glossy image is required, the apparatus attempts to form such glossy image by passing the recording medium through the fixing unit at relatively low speed. However, this type of conventional apparatus is arranged such that the recording medium is allowed to pass through the fixing unit only one time and thus cannot easily obtain a glossy image having a high image quality although a matted image can be obtained.

Where a glossy image is obtained by allowing a recording medium to pass through a fixing unit at low speed, a large quantity of heat is supplied. If a large quantity of heat is supplied over a long period of time, so-called offset easily takes place wherein toner adheres to the fixing unit (for example, a fixing roller). Thus, the quality of the image easily deteriorates.

Therefore, the above-mentioned conventional technology, based on sheet feeding speed, cannot easily and selectively obtain a matted image or a glossy image having an excellent image quality. When a glossy image is required, another problem arises in that the conveying speed of the recording medium, is reduced undesirably.

<Problem 3>

The double-side copying machine disclosed in Japanese Patent Publication No. 61-11865 as shown in FIG. 9(*b*) is structured such that when the next copying paper 7*b* is introduced simultaneously with the discharge of the preceding copying paper 7*a* from the right-side/reverse-side converting unit 10, the leading end 7*b*1 of the next copying paper 7*b* is guided by the upper surface of the preceding copying paper 7*a*. Therefore, the reverse side (the side on which no image has been formed) of the next copying paper 7*b* and the upper surface (the side on which an image has been formed) of the preceding copying paper 7*a* are brought into slidable contact with each other.

This structure gives rise to a problem in that both the reverse side of the next copying paper 7*b* and the upper surface of the preceding copying paper 7*a* are contaminated (as a result of which both of the sides of copying paper sheets following the copying paper 7*b* are contaminated).

If the copying paper is plain paper which has been electrostatically charged or thin paper, or if the copying paper is paper, such as a postcard or an envelope, which can strongly be curled, the leading end 7*b*1 of the next copying paper 7*b* cannot appropriately be guided by the upper surface of the preceding copying paper 7*a*. As a result, there arises a problem in that clogging of paper easily takes place.

The copying machine disclosed in Japanese Patent Laid-Open No. 6-1394 is structured to simply discharge paper sheets, that follow the paper sheet which has caused clogging, to the tray. Similarly to the conventional and usual image forming apparatuses, the copying machine in Japanese Patent Laid-Open No. 6-1394 has a structure in which the operation for forming images is temporarily interrupted if a paper sheet is clogged.

SUMMARY OF THE INVENTION

A first object of the present invention is to provide an image forming apparatus which is capable of solving at least Problem 1, which has a double-side mode and a single-side mode, in which clogging of a recording medium does not easily take place although the recording medium can be allowed to pass through the fixing unit plural times in a single-side mode and with which a matted image having an excellent image quality or a glossy image can selectively be obtained.

To achieve the above-mentioned first object, an image forming apparatus of the present invention includes: an image forming portion for forming a non-fixed image on a recording medium; and a fixing unit having first and second rollers each having a surface layer and arranged to fix the non-fixed image to the recording medium by conveying the recording medium while heating and applying pressure to the recording medium, and having a double-side mode for forming images on both sides of the recording medium, and having a single-side mode for forming an image on either side of the recording medium, wherein the single-side mode has a selection-permitted inverse and re-fixing sub-mode in which the recording medium allowed to pass through the fixing unit one time is again allowed to pass through the fixing unit at least one more time such that the recording medium is turned inside out, and a first roller which is brought into contact with the non-fixed image on the recording medium when the recording medium is allowed to pass through the fixing unit at the first pass, and a second roller which is brought into contact with the image on the recording medium when the recording medium is allowed to pass through the fixing unit at the second pass, wherein the hardness of the surface layer of the second roller is larger than that of the surface layer of the first roller. The second roller of the image forming apparatus further includes a surface layer which is made of resin having a releasing characteristic.

To achieve the above-mentioned first object, an image forming apparatus claimed in claim 1 comprises: a fixing unit for moving a recording medium while heating and applying pressure to the recording medium and arranged in such a manner as to form a non-fixed image on the surface of the recording medium and then allow the recording medium to pass through the fixing unit plural times so as to fix the image to the recording medium, wherein when the recording medium is allowed to pass through the fixing unit plural times, the conveying speed at which the recording medium is conveyed by the fixing unit at second and following conveying operations is made to be lower than the conveying speed at a first conveying operation.

When the recording medium is allowed to pass through the fixing unit plural times, the recording medium is allowed to pass through the fixing unit one time, and then the recording medium is turned inside out at the second and following conveying operations.

A second object of the present invention is to provide an image forming apparatus which is able to simultaneously solve Problems 1 and 2, which has a double-side mode and a single-side mode, in which clogging of a recording medium does not easily take place although the recording medium can be allowed to pass through the fixing unit plural times in a single-side mode and with which a matted image having an excellent image quality or a glossy image having an excellent image quality can selectively be obtained.

To achieve the above-mentioned second object, the temperature of the surface of the second roller is higher than the temperature of the surface of the first roller.

To achieve the first or second object, the image forming apparatus of the present invention, includes an inverse and re-fixing sub mode wherein the inverse and re-fixing sub-mode is a mode in which the recording medium is allowed to pass through the fixing unit an even number of times, and the shape of a nipping portion between the first and second rollers is formed into a recess facing the second roller when the recess is viewed from the axial direction of the nipping portion.

The inverse and re-fixing sub-mode is selected in accordance with the type of the recording medium or the type of the image which is obtained after a fixing process has been completed.

The image forming apparatus of the present invention, further includes an inverting and returning passage for turning inside out the recording medium allowed to pass through the fixing unit one time in the double-side mode and again returning the recording medium to the image forming portion. The inverting and returning passage is employed as a passage through which the recording medium is turned inside out and again returned to the fixing unit in the inverse and re-fixing sub-mode. The inverting and returning passage has a length which is sufficient to accommodate a plurality of recording mediums.

A third object of the present invention is to provide an image forming apparatus capable of overcoming the above-mentioned contamination and clogging problems (problem 3). Another object of the present invention is to provide an image forming apparatus capable of forming images on both sides of paper while preventing contamination of both sides of the paper and also preventing occurrence of paper clogging.

A fourth object of the present invention is to provide an image forming apparatus which is capable of overcoming the above-mentioned clogging and interruption problems by continuing the operations for forming images on the following paper sheets and discharging the paper sheets even if a paper sheet is clogged.

To achieve the above-mentioned object, an image forming apparatus includes: an image forming portion for forming an image on a recording medium;

first and second passages into which the recording medium having the image formed on either side thereof is introduced or from which the recording medium is discharged;

guide means disposed between the first and second passages and arranged to completely separate the first and second passages from each other so as to make them independent passages;

introducing and discharging means disposed at the inlet portions of first and second passages and capable of introducing the recording medium moved from the image forming portion into the first passage or the second passage and discharging the recording medium temporarily introduced therein; and a returning passage for returning the paper sheet discharged by the introducing and discharging means to the image forming portion.

The image forming apparatus, further includes a receiving portion for receiving the recording medium having the image formed thereon and discharged by the image forming portion, wherein the first and second passages are composed of first and second paper-discharge passages capable of independently discharging the paper sheet having the image formed by the image forming portion.

The introducing and discharging means is means capable of simultaneously introducing the paper sheet and discharging the paper sheet. The image forming apparatus also includes at least one conveying means capable of moving the paper sheet in the introducing direction and conveying another paper sheet into a discharging direction. The conveying means is provided downstream of the introducing and discharging means in a direction in which the paper sheet is introduced. Therefore, introduction and discharging of recording mediums can furthermore reliably be performed. As a result of increased reliability, the rate of occurrence of clogging is reduced.

The introducing and discharging means incorporates a drive roller disposed between the first and second passages, a first follower roller pressed against the drive roller at a position adjacent to the first passage, a second follower roller pressed against the drive roller at a position adjacent to the second passage and a switching guide disposed rotatively about a shaft disposed between the first and second passages and having a leading end facing the first follower roller or the second follower roller. Therefore, the recording medium which must be introduced into the first passage or the second passage is reliably guided by the switching guide.

The conveying means incorporates a drive roller disposed between the first and second passages, a first follower roller pressed against the drive roller at a position adjacent to the first passage and a second follower roller pressed against the drive roller at a position adjacent to the second passage. Therefore, the structure of the conveying means is simplified and more compact, thus saving space.

To achieve the above-mentioned a fourth object, an image forming apparatus of the present invention includes:

- a receiving portion for receiving recording mediums discharged after images have been formed on the recording mediums;
- a first paper-discharge passage for discharging, to the receiving portion, the recording medium on which images have been formed;
- a second paper-discharging passage for discharging, to the receiving portion, the recording mediums on which images have been formed such that the recording mediums are discharged independently from the first paper-discharge passage;
- switching means for introducing the recording mediums, on which images have been formed, to either of the first paper-discharge passage or the second paper-discharge passage;
- inlet-portion detection means for detecting when the trailing end of the recording medium introduced into the first paper-discharge passage or the second paper-discharge passage has passed through an inlet portion of the paper-discharge passage;
- clogging detection means for detecting clogging of the recording medium, on which the image has been formed, in the paper discharge passage; and
- control means for switching the switching means to the other paper discharge passage when clogging of the recording medium has been detected by the clogging detection means and passage of the trailing end of the paper sheet has been detected by the inlet-portion detection means.

To achieve the above-mentioned objects, an image forming apparatus of the present invention includes:

- a nipping portion, between the first and second rollers, is formed into a recess facing a roller which is brought into contact with an image forming surface of the recording medium which is allowed to finally pass through the fixing unit in: a) the inverse and re-fixing sub-mode; or b) a case where the recording medium having an image formed on either side thereof is allowed to pass through the fixing unit plural times; when the recess is viewed from an axial direction of the recess.

The image forming apparatus of the present invention also has a structure in which a non-fixed image is formed on the surface of a recording medium. Then, the recording medium is allowed to pass through the fixing unit so as to be conveyed while being heated and applied with pressure by the fixing unit.

Thus the non-fixed image is fixed to the recording medium such that a plurality of the number of times is selected.

The image forming apparatus has an image forming portion for forming a non-fixed image on the recording medium. The recording medium is conveyed by the first and second rollers of the fixing unit while being heated and applied with pressure. The first and second rollers each have a surface layer. Thus, the non-fixed image is fixed to the recording medium.

In the case of a double-side mode, images are formed on both sides of the recording medium. In the case of a single-side mode, an image is formed on only one side of the recording medium, but that one side may be either side of the recording medium.

When the inverse and re-fixing sub-mode is selected in the single-side mode, the recording medium allowed to pass through the fixing unit one time is turned inside out and allowed to again pass through the fixing unit at least one more time. The recording medium may thus be allowed to finally pass an even number of times. Therefore, accumulation of curls of the recording medium is prevented.

The image forming apparatus of the present invention has a double-side mode and a single-side mode. Although a recording medium can be allowed to pass through the fixing unit several times in the single-side mode, clogging of the recording medium does not easily take place.

The first roller is a roller which is brought into contact with the non-fixed image on the recording medium when the recording medium is allowed to pass through the fixing unit at the first pass. The second roller is a roller which is brought into contact with the image on the recording medium when the recording medium is allowed to pass through the fixing unit at the second pass. The hardness of the surface layer of the second roller is higher than that of the surface layer of the first roller. As an alternative, or in addition to the difference in surface hardness, the temperature of the surface of the second roller is higher than the temperature of the surface of the first roller. Therefore, a matted image or a glossy image having an excellent image quality can selectively be obtained.

More specifically, the image forming apparatus of the present invention enables a matted image to be obtained by allowing a recording medium having a non-fixed image formed in, for example, the single-side mode (except for the inverse and re-fixing sub-mode), to pass through the fixing unit one time. As the recording medium passes through the fixing unit, the non-fixed image on the recording medium is brought into contact with the first roller having the surface layer with a relatively low hardness and/or a relatively low temperature. Therefore, a somewhat rough state is realized by toner particles which have been left on the surface of the image and have not completely been melted. As a result, a matted image having an excellent image quality is obtained.

To obtain a glossy image, the recording medium having a non-fixed image formed in the inverse and re-fixing sub-mode is allowed to pass through the fixing unit one time so that a matted image is formed. Then, the recording medium is turned inside out, and is allowed to again pass through the fixing unit at least one more time (i.e., two or more times in total). Thus, a relatively large quantity of heat is supplied so that the matted image is formed into a glossy image. Thus, a glossy image is obtained. Since the matted image on the recording medium is brought into contact with the second roller incorporating the surface layer with a relatively high hardness and/or a relatively high temperature, the surface of the toner image which has completely been melted is smoothed. As a result, a glossy image having an excellent image quality is obtained.

Specifically, the foregoing image forming apparatus enables the matted image by allowing a recording medium having a non-fixed image formed in, for example, the single-side mode (except for the inverse and re-fixing sub-mode) to pass through the fixing unit one time. Since the non-fixed image on the recording medium is brought into contact with the first roller having the relatively low temperature, a matted image having an excellent image quality is easily obtained.

When a glossy image is desired, a recording medium having a non-fixed image formed in the inverse and re-fixing sub-mode is allowed to pass through the fixing unit one time so that a matted image is formed. Then, the recording medium is turned inside out, and then allowed to again pass through the fixing unit at least one more time (i.e., two times in total). Thus, a relatively large quantity of heat is supplied so that the matted image is formed into a glossy image. As a result, a glossy image is obtained. Since the matted image on the recording medium is brought into contact with the second roller having a relatively high temperature, a glossy image having an excellent image quality can easily be obtained.

In contrast to the conventional technology disclosed in Japanese Patent Publication No. 6-40235, it is not necessary to reduce the speed at which the recording medium is allowed to pass through the fining unit of the present invention. Therefore, a glossy image having an excellent image quality can be obtained at a relatively high speed if desired.

However, a glossy image can also be produced by varying the speed of conveyance as follows. When the recording medium is allowed to pass through the fixing unit plural times, the conveying speed at which the recording medium is conveyed by the fixing unit at second and following conveying operations is lower than the conveying speed at a first conveying operation. Therefore, a glossy image having an excellent image quality can easily be obtained.

Specifically, the foregoing image forming apparatus enables a matted image to be obtained by allowing a recording medium having a non-fixed image formed thereon to pass through the fixing unit one time at relatively high speed.

When a glossy image is desired, the recording medium having a non-fixed image formed thereon is allowed to pass through the fixing unit one time at relatively high speed. Then, the recording medium is allowed to pass through the fixing unit at relatively low speed at the second and following conveying operations. Thus, a great quantity of heat is supplied so that the matted image is formed into a glossy image. Thus, the glossy image is obtained.

When the recording medium is allowed to pass through the fixing unit at the second or following time, the recording medium has already been allowed to pass through the fixing unit one time. Since the developer, such as toner, is melted to a degree with which the matted image can be obtained at the first fixing operation, cohesive force between developers and the bonding strength between the developer and the recording medium have considerably been enlarged as compared with those of the non-fixed image. Therefore, even when a large quantity of heat is supplied by the second roller having the relatively high temperature, or low conveying speed, offset does not easily take place.

Therefore, when a glossy image, in particular, a color image, is formed by the image forming apparatus of the present invention, a greater quantity of heat is supplied by the second roller so that a glossy image having excellent color developing characteristic, transparency and luster is obtained. Therefore, a glossy image having an excellent image quality is easily obtained with a small number of fixing operations.

The present invention also prevents clogging of the recording medium. When the recording medium is allowed to pass through the fixing unit plural times, the recording medium is allowed to pass through the fixing unit one time, and then the recording medium is turned inside out at the second and following conveying operations. Therefore, accumulation of curls of the recording medium is prevented although the recording medium is allowed to pass through the fixing unit plural times. Therefore, clogging of the recording medium is satisfactorily prevented.

In the related art, by contrast, a recording medium allowed to pass through a fixing unit is curled. The technologies disclosed in Japanese Patent Publication No. 5-48917 and Japanese Patent Publication No. 6-68646 have a structure in which the recording medium having an image on either side thereof is allowed to pass through the fixing unit two times. However, the recording medium is not turned inside out. Therefore, there arises a problem in that the recording medium is curled excessively, causing recording mediums to easily clog in a conveying passage.

The image forming apparatus of the present invention is structured such that when the recording medium is allowed to pass through the fixing unit plural times, the recording medium is first allowed to pass through the fixing unit one time in a first orientation. The recording medium is then turned inside out for the second and following conveying operations. Therefore, accumulation of curls of the recording medium is prevented although the recording medium is allowed to pass through the fixing unit multiple times. Therefore, clogging of the recording medium does not easily take place.

In the image forming apparatus of the present invention, the inverse and re-fixing sub-mode is a mode in which the recording medium is allowed to pass through the fixing unit an even number of times, and the shape of a nipping portion between the first and second rollers is formed into a recess facing the second roller when the recess is viewed from the axial direction of the nipping portion. Therefore, when the recording medium is finally allowed to pass through the fixing unit, the recording medium is moved such that the recording medium is caused to face a direction in which the recording medium is separated from the surface of the second roller which is brought into contact with the image forming surface of the recording medium.

Moreover, the second roller is made of resin having a releasing characteristic. Therefore, winding of the recording medium around the second roller in the inverse and re-fixing sub-mode can satisfactorily be prevented.

Therefore, winding of the recording medium around the second roller is satisfactorily prevented by the present invention. As a result, the recording medium is smoothly conveyed.

The inverse and re-fixing sub-mode is selected in accordance with the type of the recording medium or the type of the image which is obtained after a fixing process has been completed. Therefore, when an image is formed on only one side of the recording medium in the single-side mode, images having a variety of image qualities corresponding to various recording mediums can be obtained.

The image forming apparatus further includes an inverting and returning passage for turning inside out the recording medium allowed to pass through the fixing unit one time in the double-side mode and again returning the recording medium to the image forming portion. The inverting and returning passage is employed as a passage through which the recording medium is turned inside out and again returned to the fixing unit. Therefore, the structure of the passage is simplified and the size of the apparatus is reduced.

The inverting and returning passage has a length sufficient to accommodate a plurality of recording mediums. Therefore, an intermediate tray is not required in the double-side mode to efficiently form images on both sides of a recording medium. Moreover, clogging of the recording medium in the inverse and re-fixing sub-mode is satisfactorily prevented. Since an intermediate tray is not required, the size of the apparatus is reduced.

In contrast, the apparatus disclosed in Japanese Patent Publication No. 6-68646 has a structure in which the double-side mode for forming images on both sides of the recording medium is performed such that a plurality of recording mediums each having an image on either side thereof are accumulated in an intermediate tray. Then, the recording medium is again supplied from the intermediate tray to the image forming portion so as to form an image on the other side. Thus, images can efficiently be formed on both sides. However, when a glossy image is formed on an OHP film in the single-side mode in which an image is formed on either side of the recording medium, a plurality of OHP films are temporarily accumulated in the intermediate tray. Then, the OHP film is again supplied from the intermediate tray to the fixing unit. Therefore, the OHP films easily adhere when the plural OHP films are stacked in the intermediate tray. Therefore, there arises a problem in that a defect (clogging of paper) or undesirable stacking easily takes place in the moving operation. Since a space for disposing the paper feeding tray is required, there arises a problem in that the size of the apparatus cannot be reduced.

In the image forming apparatus of the present invention, the inverting and returning passage has a length sufficient to accommodate a plurality of recording mediums. Therefore, an intermediate tray is not required in the double-side mode to efficiently form images on both sides of the recording medium. Since the intermediate tray is not required, the above-mentioned problems do not arise. Therefore, clogging of the recording medium in the inverse and re-fixing sub-mode is satisfactorily is prevented. Since the intermediate tray is not required, the size of the apparatus is reduced.

The image forming apparatus of the present invention further includes first and second discharge passages. The recording medium having an image on either side is, by the introducing and discharging means, temporarily introduced into the first passage or the second passage, and then discharged. The discharged recording medium is allowed to pass through the returning passage so as to be returned to the image forming portion. Thus, an image is formed on the other side.

The recording medium, on either side of which the image has been formed, is introduced into the first passage or the second passage or discharged. Therefore, discharge of the recording medium from the first passage and introduction of a recording medium into the second passage can simultaneously be performed. The image forming apparatus of the present invention incorporates guide means disposed between the first passage and the second passage. The guide means makes the first passage and the second passage independent passages, separated from each other. Therefore, slidable contact between recording mediums which are introduced into the first passage or the second passage or discharged from the same is prevented. Therefore, the image forming apparatus is able to prevent contamination of both sides of recording medium.

The recording medium which is introduced into the first passage or the second passage or discharged from the same is guided by the guide means. Since the recording medium is not guided by the preceding recording medium as has been performed in the conventional apparatus, clogging of the recording medium is prevented.

That is, the image forming apparatus of the present invention is able to form images on both sides of recording mediums, prevent contamination of both sides of the recording mediums, and prevent clogging.

The image forming apparatus of the present invention further includes a receiving portion for receiving the recording medium having the image formed thereon and discharged by the image forming portion. The first and second passages are composed of first and second paper-discharge passages capable of independently discharging the recording medium. Therefore, a recording medium introduced into the first passage or the second passage is moved to the returning passage or discharged to the receiving portion.

Moreover, the recording medium introduced into the first passage or the second passage can be selectively moved to the returning passage or discharged to the receiving portion. Therefore, freedom of the operation mode of the apparatus is enhanced. Also, by having both first and second discharge passages, the space in the apparatus is effectively used.

The image forming apparatus of the present invention also includes switching means for introducing the recording mediums, on which images have been formed, to either of the first paper-discharge passage or the second paper-discharge passage. Therefore, if a recording medium is clogged in the first paper-discharge passage or the second paper-discharge passage, the switching means introduces the recording medium to another paper discharge passage. Thus, the recording medium, on which images have been formed, can be discharged to the receiving portions without interruption of the image forming operation.

The image forming apparatus thus includes inlet-portion detection means for detecting when the trailing end of the recording medium introduced into the first paper-discharge passage or the second paper-discharge passage has passed through an inlet portion of the paper-discharge passage; clogging detection means for detecting clogging of the recording medium in the paper discharge passage; and control means for switching the switching means to the other paper discharge passage when clogging of the recording medium has been detected by the clogging detection means and passage of the trailing end of the recording medium has been detected by the inlet-portion detection means. When a fact that the trailing end of the recording medium has passed the inlet portion of the foregoing paper discharge passage has been detected by the inlet-portion detection means, the control means automatically switches the switching means. Thus, the following recording mediums are introduced into the other paper discharge passage and are discharged.

If the inlet-portion detection means is not provided and therefore the switching means is switched to the other paper discharge passage though the trailing end of the recording medium has not passed the inlet portion of the paper discharge passage, the trailing end of the paper sheet exists in the inlet portion (a position adjacent to the inlet portion of the other paper discharge passage) of each paper discharge passage which is the branching portion between the first and second paper-discharge passages. Therefore, there is a risk that the foregoing trailing end is brought into contact with the leading end of the following recording medium, thereby preventing the following recording medium from always and reliably being introduced into the other paper discharge passage.

On the other hand, the image forming apparatus of the present invention has a structure in which the switching means is switched when the fact that the trailing end of the recording medium is passed the inlet of the paper discharge passage has been detected (or is being detected) if the recording medium introduced into the first paper-discharge passage or the second paper-discharge passage is clogged. Therefore, interference between the trailing end of the clogged recording medium and the following recording medium is prevented. Thus, the following recording mediums each having an image formed thereon are reliably introduced into the other paper discharge passage so as to be discharged.

As described above, the image forming apparatus has a structure in which the switching means is automatically switched so as to reliably introduce the following recording mediums into a paper discharge passage, other than a first one which is clogged, so as to be discharged. The switching means is automatically switched if either a recording medium is clogged in the first paper-discharge passage or the second paper-discharge passage. Therefore, if a recording medium is clogged, images can be formed on the following recording mediums so as to discharge the recording mediums normally.

BRIEF DESCRIPTION OF THE DRAWINGS

The above and other objects and advantages of the present invention will become more apparent by describing in detail, preferred embodiments thereof with reference to the drawings in which.

DETAILED DESCRIPTION OF THE INVENTION

An embodiment of the present invention will now be described with reference to the drawings.

Figure 1:
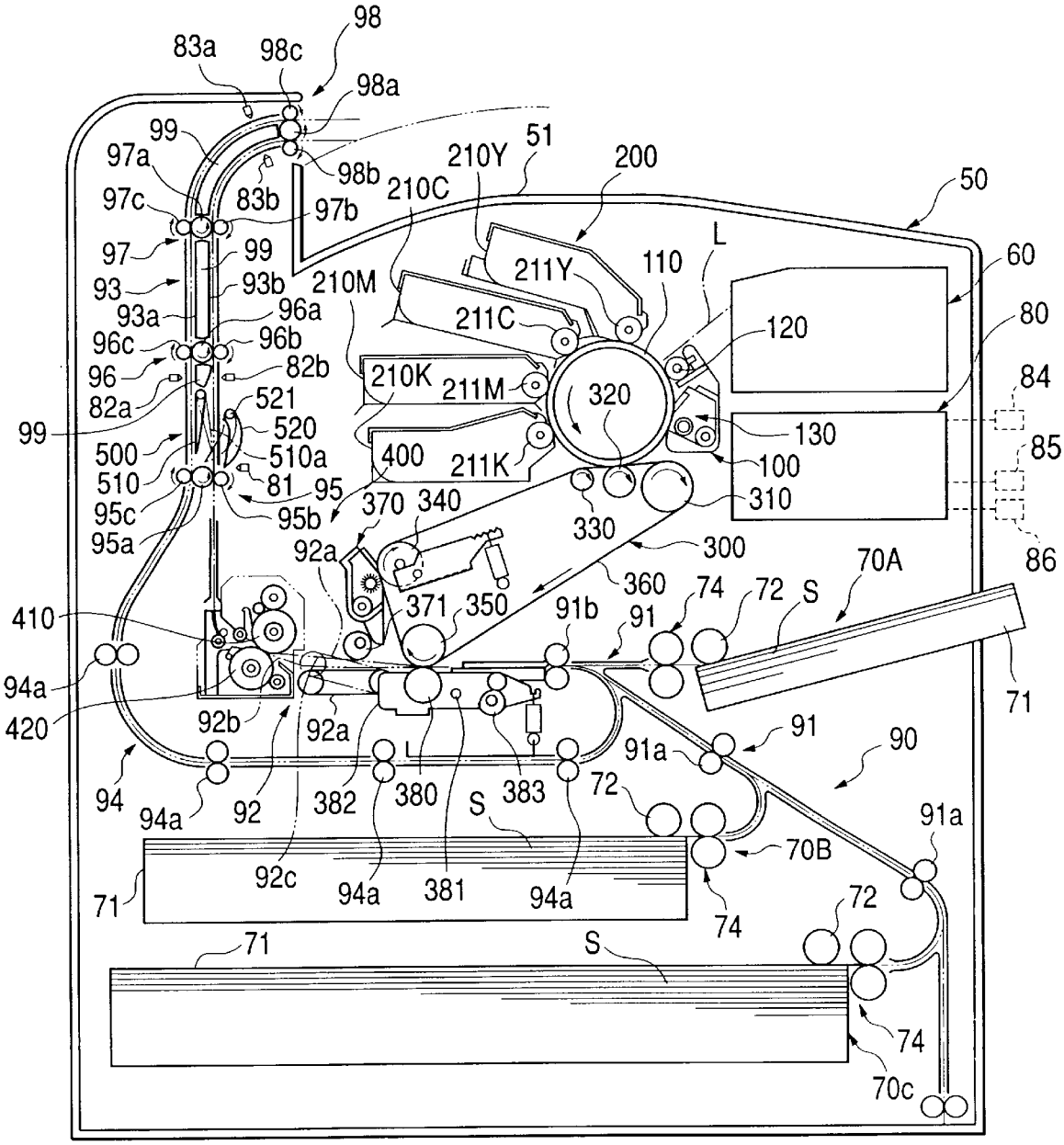
FIG. 1 is a diagram showing the internal structure of an embodiment of an image forming apparatus according to the present invention.

FIG. 1 is a diagram showing the internal structure of an embodiment of an image forming apparatus according to the present invention. The image forming apparatus according to this embodiment is a laser printer incorporating developing units using yellow, cyan, magenta and black toner and capable of forming a full color image.

Referring to FIG. 1, reference numeral 50 represents a case of the body of the apparatus. The case 50 houses three paper feeding units (70A, 70B and 70C), an exposing unit 60, a photosensitive-member unit 100, a development unit 200, an intermediate transfer unit 300, a fixing unit 400 which is a fixing device, and a control unit 80 for totally controlling the apparatus and the like. A receiving portion 51 for receiving a recording medium finally discharged after an image has been formed is formed on the upper surface of the case 50.

A paper supply portion of the image forming apparatus according to this embodiment is composed of the paper feeding units 70 (A, B and C). An image forming portion is composed of the exposing unit 60, the photosensitive-member unit 100, the development unit 200 and the intermediate transfer unit 300. In the case 50, a paper conveying passage 90 is formed from the paper supply portion to the receiving portion 51 through the image forming portion and the fixing unit 400.

The paper feeding units 70 (A, B and C) each include a cassette 71 in which a plurality of stacked recording mediums S are accommodated, a pickup roller 72 arranged to be brought into contact with an uppermost recording medium among the accommodated recording mediums S, and a separating roller pair 74 for reliably and sequentially separating from one another the recording mediums which must be supplied by the pickup roller 72.

The recording medium supplied by the paper feeding units 70 (A, B and C) is moved to a gate roller pair 91*b* by a conveying roller pair 91*a* of a supply passage 91 of the paper conveying passage 90 to be described later. The recording medium is, by the gate roller pair 91*b*, supplied to a position between an intermediate transfer belt 360, which is a second transfer portion in the image forming portion, and a secondary transfer roller 380 at predetermined timing.

The paper conveying passage 90 has a supply passage 91 for supplying the recording medium from any one of the three paper feeding units 70 (A, B and C) to the image forming portion, a movable passage 92 for moving the recording medium on which an image has been formed in the image forming portion to the fixing unit 400, a paper-discharge passage 93 for turning inside out the recording medium to which the image has been fixed by the fixing unit 400 or discharging the same to the receiving portion 51 as necessary and a returning passage 94 which is employed when a double-side mode (to be described later) is selected or an inverse and re-fixing sub-mode is selected. That is, this embodiment has a structure in which the inverting and returning passage is composed of the paper-discharge passage 93 and the returning passage 94, as described later.

The supply passage 91 has a conveying roller pair 91*a* for moving the recording medium and a gate roller pair 91*b* for determining timing at which the recording medium is moved to the image forming portion.

The movable passage 92 has a conveying belt 92*a* with which the lower surface of the recording medium is brought into contact. The conveying belt 92*a* guides the recording medium and supplies moving force to the recording medium. When the length of the recording medium in a direction in which the same is moved (the length in the horizontal direction in FIG. 1) is longer than the distance from a nipping portion between a backup roller 350 (of the intermediate transfer unit 300) and the secondary transfer roller 380, and a nipping portion between a first roller 410 (of the fixing unit 400) and the second roller 420, the conveying belt 92*a* forms a warped passage 92*b*. The warped passage 92*b* is formed substantially horizontally as indicated with a solid line so that the recording medium (for example, plain paper or the like having B-5 size or larger) is moved in a state in which the recording medium is warped. When the length of the recording medium is shorter than the above-mentioned distance, the conveying belt 92*a* forms a straight passage 92*c* formed at a diagonal position facing the nipping portion between the first roller 410 and the second roller 420 and arranged to linearly move the recording medium (for example, an envelope positioned horizontally) to the nipping portion between the first roller 410 and the second roller 420, as indicated with an imaginary line.

The paper-discharge passage 93 has first and second paper-discharge passages 93*a* and 93*b*. A first conveying roller portion 95 is disposed at the inlet portion (at the lower end in the drawing) of first and second paper-discharge passages 93*a* and 93*b*. The first conveying roller portion 95 is composed of one drive roller 95*a*, a first follower roller 95*c*, pressed against the drive roller 95*a* at a position adjacent to the first paper-discharge passage 93*a*, and a second follower roller 95*b* pressed against the drive roller 95*a* at a position adjacent to the second paper-discharge passage 93*b*. A second conveying roller portion 96 is formed above the first conveying roller portion 95. The second conveying roller portion 96 is similarly composed of one drive roller 96*a* and two follower rollers 96*b* and 96*c* arranged to be pressed to the two sides of the drive roller 96*a*. A third conveying roller portion 97 is formed above the second conveying roller portion 96. The third conveying roller portion 97 is similarly composed of one drive roller 97*a* and two follower rollers 97*b* and 97*c* arranged to be pressed against the two sides of the drive roller 97*a*. Moreover, a paper-discharge roller portion 98 is formed at an outlet portion (at an upper end in the drawing) of the first and second paper-discharge passages 93*a* and 93*b*. The paper-discharge roller portion 98 is composed of one drive roller 98*a* and two follower rollers 98*b* and 98*c* arranged to be pressed against the two sides of the drive roller 98*a*.

Central guides 99, serving as guide means, are disposed among the roller portions 95 to 97 to completely separate the first paper-discharge passage 93*a* and the second paper-discharge passage 93*b* from each other to form independent paper-discharge passages.

The first conveying roller portion 95 is arranged to always be rotated in an inverted direction (a direction indicated by an arrow, i.e., with drive roller 95*a* rotating counterclockwise as shown in FIG. 1). However, the second and third conveying roller portions 96 and 97 and the paper-discharge roller portion 98 are structured to be capable of rotating both forwards and inversely, i.e., drive rollers 96*a*, 97*a*, and 98*a* can rotate either clockwise or counterclockwise as shown in FIG. 1. Note that the follower rollers 96*b*, 96*c*, 97*b*, 97*c*, 98*b* and 98*c* have for example, a separating mechanism so that they can be separated with respect to their corresponding driver rollers. Therefore, rotation of the follower rollers associated with a corresponding drive roller can be suspended.

Figure 2:
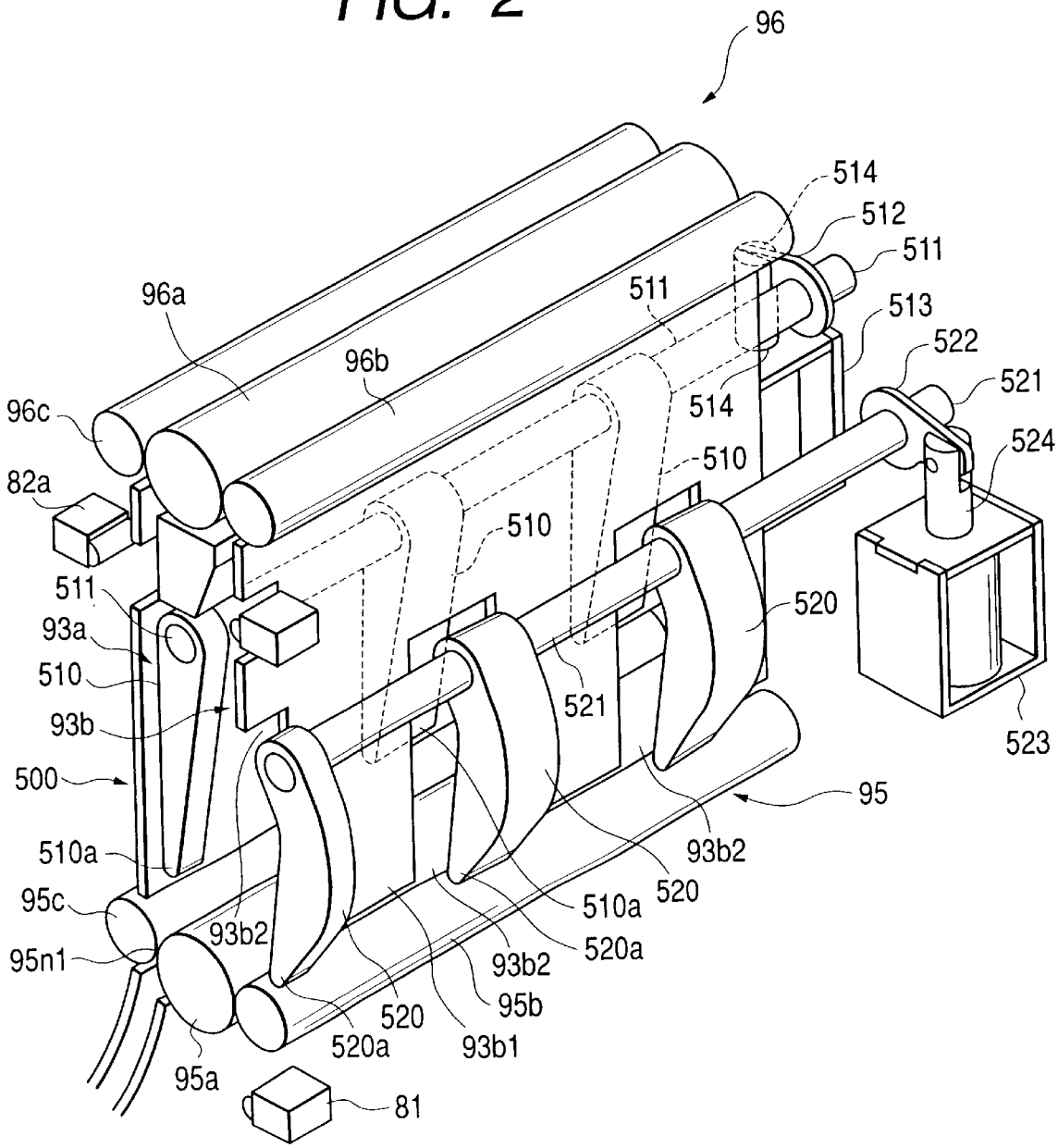
FIG. 2 is a perspective view mainly showing an introducing and discharging means.

A switch unit 500 is disposed between the first conveying roller portion 95 and the second conveying roller portion 96. As shown in FIG. 2, the switch unit 500 has a first switch guide 510 and a second switch guide 520.

The first switch guide 510 serves as a guide means for completely separating the first paper-discharge passage 93*a* and the second paper-discharge passage 93*b* from each other so that they are independent passages.

The first switch guide 510 also serves as a switch means for introducing the recording medium, to which an image has been formed and fixed, into either of the first paper-discharge passage 93*a* or the second paper-discharge passage 93*b*. Moreover, the first switch guide 510 introduces the recording medium that was temporarily introduced into the first paper-discharge passage 93*a*, into the paper-discharge passage 93. The first switch guide 510 is secured to a shaft 511 disposed between the first paper-discharge passage 93*a* and the second paper-discharge passage 93*b*. An arm 512 is secured to an end of the shaft 511. A pin 514 of a solenoid 513 is connected to the leading end of the arm 512. Therefore, when the pin 514 has been moved upwards, the first switch guide 510 is brought to a position at which the leading end 510*a* of the first switch guide 510 faces the first follower roller 95*c*, as indicated with solid lines shown in FIGS. 1 and 2. When the pin 514 has been moved downwards, the first switch guide 510 is rotated counterclockwise as indicated with an imaginary line shown in FIG. 1.

The second switch guide 520 introduces the recording medium that was temporarily introduced into the second paper-discharge passage 93*b* into the returning passage 94. The second switch guide 520 is secured to a shaft 521 disposed on the outside of a guide plate 93*b*1 for guiding either side of the second paper-discharge passage 93*b*. An arm 522 is secured to an end of the shaft 521. A pin 524 of a solenoid 523 is connected to a leading end of the arm 522. Therefore, when the pin 524 has been moved upwards, the second switch guide 520 is brought to a position retracted from the second paper-discharge passage 93*b*, as indicated with solid lines shown in FIGS. 1 and 2. When the pin 524 has been moved downwards, the second switch guide 520 is rotated clockwise so that the leading end of the second switch guide 520 is introduced into the second paper-discharge passage 93*b*.

The guide plate 93*b*1 has a cut portion 93*b*2 opposite to the second switch guide 520. When the second switch guide 520 has been rotated clockwise, a leading end 520*a* of the second switch guide 520 is introduced into the cut portion 93*b*2 so as to be moved to a nipping portion 95*n*1 between the drive roller 95*a* and the first follower roller 95*c* (refer to an imaginary line shown in FIG. 1).

When the first switch guide 510 has been rotated counterclockwise, a leading end 510*a* of the first switch guide 510 is introduced into the cut portion 93*b*2 (refer to the imaginary line shown in FIG. 1).

An inlet-portion detection means 81 is disposed at the inlet portions of the first and second paper-discharge passage 93*a* and 93*b*. The inlet-portion detection means 81 detects when the trailing end of the recording medium introduced through the first and second paper-discharge passages 93*a* and 93*b* has passed through the inlet portions of the foregoing paper-discharge passages. The detection means 81 comprises a photosensor which is turned on if the recording medium exists at a position opposite to the photosensor. The photosensor is turned off if the recording medium does not exist at a position opposite the photosensor.

A plurality of photosensors 82*a*, 83*a*, 82*b* and 83*b* serving as clogging detection means for detecting when the recording medium has been clogged in the paper-discharge passage are disposed at arbitrary positions in the first and second paper-discharge passages 93*a* and 93*b*. In this embodiment, the foregoing photosensor 81 constituting the inlet detection means also constitutes a portion of the clogging detection means.

The photosensors 81, 82*a*, 83*a*, 82*b* and 83*b* are connected to the control unit 80 which serves as the control means.

The control unit 80 controls the overall operation of the apparatus. The control unit 80 has a double-side mode for operating the apparatus such that images are formed on the two sides of the recording medium, and a single-side mode for operating the apparatus such that an image is formed on either side of the recording medium. The single-side mode has an inverse and re-fixing sub-mode which can be selected and in which the recording medium allowed to pass through the fixing unit 400 one time is turned inside out. After the recording medium is turned inside out, it is then allowed to again pass through the fixing unit 400 at least one time so that the recording medium passes through the fixing unit 400 an even number of times.

A mode selection switch 84 for selecting the double-side mode or the single-side mode, a paper selection switch 85 for selecting the type of the recording medium and an image-quality selection switch 86 for selecting the type of the image quality obtainable after the fixing operation has been completed are connected to the control unit 80. The selection switches 84, 85 and 86 are located on an operation panel (not shown) provided on the case 50. A host computer (for example, a personal computer) (not shown) is connected to the control unit 80.

The mode selection switch 84 is operated by a user such that when images are to be formed on both sides of the recording mediums, for example, "DOUBLE SIDE" is selected. When images are to be formed on one side, for example, "SINGLE SIDE" is selected.

The paper selection switch 85 is also operated by the user. When the recording mediums on which the images must be formed are, for example, plain paper sheets, "PLAIN PAPER" is selected. When the recording mediums are OHP sheets, "OHP" is selected.

Further, the image-quality selection switch 86 is operated by a user. When a required image is a matted image (delustered image), "MAT" is selected. When a glossy image (a luster image) is required, "GLOSS" is selected.

Because the host computer is connected to the control unit 80, software installed on the host computer may be used to perform the selecting operation. However, the software must have a function for selecting the double-side mode/single-side mode, the type of the recording medium, and the type of the image quality.

The control unit 80 operates the apparatus in any one of the following modes in accordance with the states of the selection of the switches.

<Double-Side Mode>

When "DOUBLE SIDE" has been selected by operating the mode selection switch 84, the apparatus is operated in the double-side mode as described later, regardless of the states of the paper selection switch 85 and the image-quality selection switch 86.

<Normal One-Side Mode>

This mode is a single-side mode except for the inverse and re-fixing sub-mode. When "ONE SIDE" has been selected by operating the mode selection switch 84, and "MAT" has been selected by operating the image-quality selection switch 86, the control unit 80 operates the apparatus in the usual single-side mode regardless of the state of the paper selection switch 85.

<Inverse and Re-Fixing Sub-Mode>

When "ONE SIDE" has been selected by operating the mode selection switch 84, and "GLOSS" has been selected by operating the image-quality selection switch 86, the control unit 80 operates the apparatus in the inverse and re-fixing sub-mode as described later.

At this time, the number of the inverse and re-fixing operations may arbitrarily be set in accordance with the state of the paper selection switch 85.

In accordance with the selected mode, the control unit 80 performs control such that the first switch guide 510 and the second switch guide 520 are switched by operating the solenoids 513 and 523 if passage of the trailing end of the recording medium is detected by the inlet-portion detection means 81. Moreover, the control unit 80 controls the forward or reverse rotations of the second and third conveying roller portions 96 and 97 and the paper-discharge roller portion 98. When a double-side printing operation to be described later is performed, the control unit 80 performs control to operate the solenoids 513 and 523 to switch the first and second guides 510 and 520 if the inlet-portion detection means 81 detects passage of the trailing end of the recording medium has passed. Thus, if the clogging detection means detects clogging of the recording medium and if the inlet portion detection means 81 detects passage of the recording medium, the first switch guide 510 can be switched to the other paper discharging passage by operating the solenoid 513. Moreover, the control unit 80 controls the forward and reverse rotations of the second and third conveying roller portions 96 and 97 and the paper-discharge roller portion 98. The control unit 80 according to this embodiment has a storage means which is capable of storing image data corresponding to at least 16 pages of monochromic images, the size of which is A-4 size (or the letter size).

The returning passage 94 connects the first paper-discharge passage 93*a* or the second paper-discharge passage 93*b* to the supply passage 91. A conveying roller pair 94*a* for conveying the recording medium is provided in the returning passage 94. The recording medium moved from the first or second paper-discharge passage to the returning passage 94 is returned by the conveying roller pair 94*a*, and is then again supplied to the image forming portion and the fixing unit 400 through the supply passage 91.

The photosensitive-member unit 100 incorporates a photosensitive member 110 and a charging roller 120 serving as a charging means. The charging roller 120 is arranged to be brought into contact with the outer surface of the photosensitive member 110 so as to uniformly charge the outer surface of the photosensitive member 110. The photosensitive-member unit 100 further incorporates a cleaning means 130.

The developing unit 200 has development means including a yellow-color developing unit 210Y, a cyan-color developing unit 210C, a magenta-color developing unit 210M and a black-color developing unit 210K. The developing units 210Y, 210C, 210M and 210K include yellow, cyan, magenta and black toner and incorporate developing rollers 211Y, 211C, 211M and 211K. Only the developing roller of one of the developing units can be brought into contact with the photosensitive member 110 at a time.

The intermediate transfer unit 300 incorporates a drive roller 310, a primary transfer roller 320, an expanding roller 330, a tension roller 340, a backup roller 350, an endless intermediate transfer belt 360 arranged among the foregoing rollers, and a cleaning means 370. The cleaning means 370 is capable of being brought into contact with the intermediate transfer belt 360 and separated from the same upon operation of cam 371.

A secondary transfer roller 380 is disposed opposite to the backup roller 350. The secondary transfer roller 380 is rotatively supported by an arm 382. The arm 382 is supported by a support shaft 381 such that the arm 382 is able to swing. When the arm 382 is swung because of the operation of the cam 383, the secondary transfer roller 380 is brought into contact with the intermediate transfer belt 360 and separated therefrom.

The drive roller 310 has a gear (not shown) secured to an end thereof. Since the gear is engaged to a gear (not shown) provided at an end of the photosensitive-member unit 100, the drive roller 310 is rotated at substantially the same circumferential speed as that of the photosensitive member 110. Therefore, the intermediate transfer belt 360 is circulated at substantially the same circumferential speed as that of the photosensitive member 110.

The circumferential length of the intermediate transfer belt 360 according to this embodiment is longer than the length of the recording medium having a size of A-3 size (or the ledger size) disposed in a portrait state. Therefore, an image can be formed on a recording medium having the A-3 size (or the ledger size) when the intermediate transfer belt 360 is rotated one time. Thus, images can be formed on two A-4 size (or the letter size) recording mediums when the intermediate transfer belt 360 is rotated one time.

When the intermediate transfer belt 360 is circulated, a toner image on the photosensitive member 110 is transferred to the surface of the intermediate transfer belt 360 at a position between the primary transfer roller 320 and the photosensitive member 110. The toner image transferred to the surface of the intermediate transfer belt 360 is transferred to a recording medium S which is supplied to a position between the secondary transfer roller 380 and the intermediate transfer belt 360.

The recording medium S, to which the toner image has been transferred, is moved to the fixing unit 400 through the movable passage 92. In the fixing unit, the toner image is fixed to the recording medium S.

The fixing unit 400 incorporates a first roller 410 and a second roller 420 each having a heat source. The recording medium S, to which the non-fixed toner image has been formed, is moved while being heated and applied with pressure from the first and second rollers 410 and 420. Note that reference numeral 430 represents a frame for the fixing unit 400.

Figure 7:
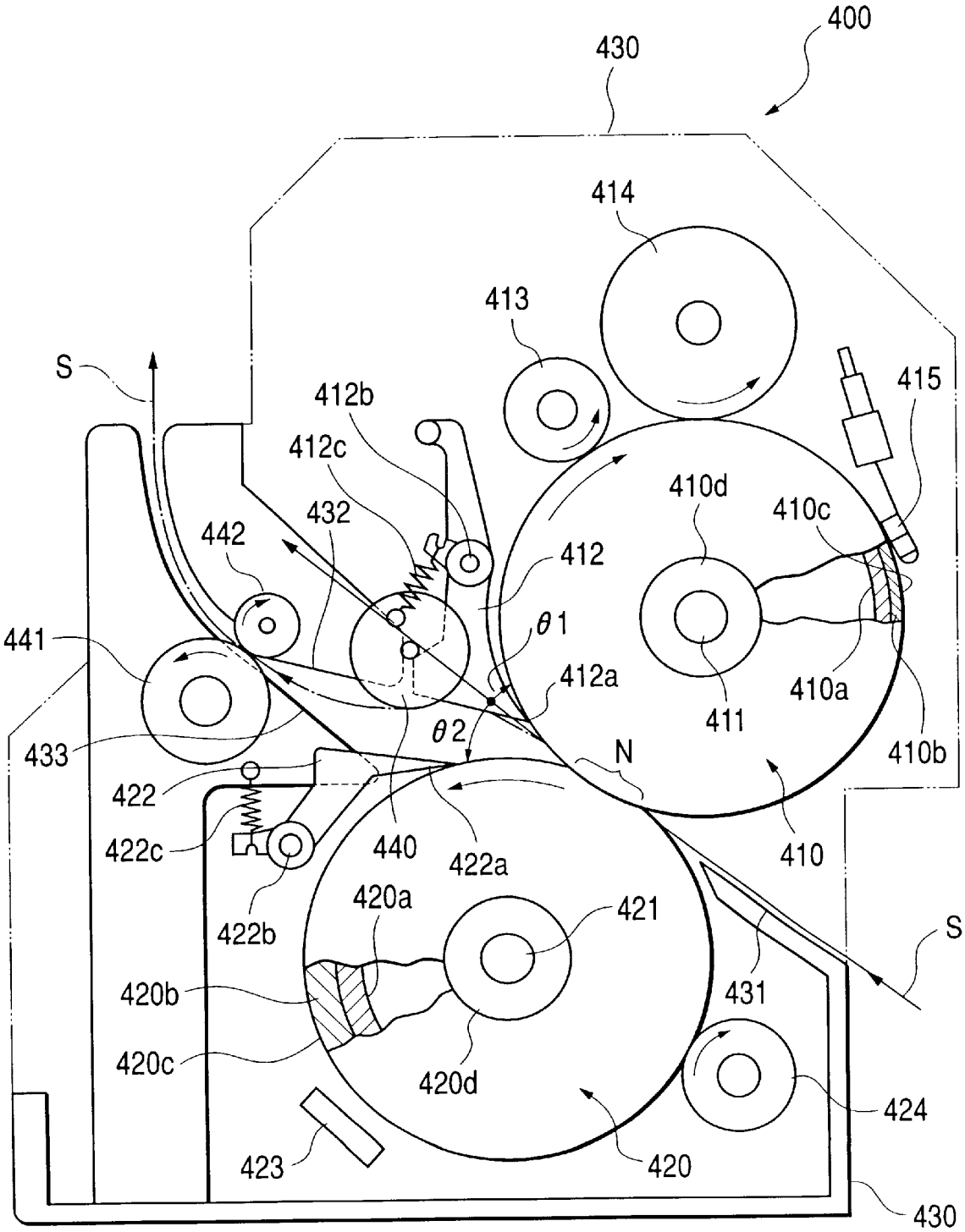
FIG. 7 is an enlarged view showing a fixing unit according to the present invention.

As shown in FIG. 7 in detail, the first roller 410 incorporates a core member 410*a* formed into a pipe shape and exhibiting excellent heat conductivity. The first roller 410 also includes an elastic layer 410*b* formed on the surface of the core member 410*a* and a surface layer 410*c* formed on the elastic layer 410*b*. The surface layer 410*c* has an excellent separating characteristic with respect to the recording medium and toner. A halogen lamp 411, which is a heat source, is disposed in the core member 410*a*. The surface layer 410*c* is made of a material (for example, silicon rubber) having a low hardness as compared with that of a surface layer 420*c* of the second roller 420 to be described later. Reference numeral 410*d* represents a bearing member for rotatively supporting the first roller 410 on to the frame 430. A separating claw 412, a cleaner roller 413, an oil roller 414 and a thermistor 415 are disposed on the outer surface of the first roller 410.

The first roller 410 is rotated in a direction indicated by an arrow (clockwise as shown in FIG. 7) by a drive means (not shown). The separating claw 412 is supported by a shaft 412*b* such that the separating claw 412 is able to swing. The separating claw 412 is urged by a spring 412*c* such that a leading end 412*a* of the separating claw 412 is brought into slidable contact with the outer surface of the first roller 410. Thus, winding of the recording medium S around the first roller 410 is prevented. The cleaner roller 413 is pressed against the first roller 410 so as to follow the first roller 410 and rotate. The clean roller 413 removes toner or the like allowed to adhere to the outer surface of the first roller 410. The oil roller 414 is pressed against the first roller 410 so as to follow the first roller 410 and rotate. The oil roller 414 applies a separating agent, such as silicon oil, to the outer surface of the first roller 410. The thermistor 415 detects the temperature of the surface of the first roller 410.

The second roller 420 incorporates a core member 420*a* in the form of a pipe and having excellent heat conductivity. The second roller 420 also includes an elastic layer 420*b* formed on the surface of the core member 420*a* and a surface layer 420*c* formed on the surface of the elastic layer 420*b*. The surface layer 420*c* has an excellent separating characteristic with respect to the recording medium and toner. A halogen lamp 421, which is a heat source, is disposed in the core member 420*a*. The surface layer 420*c* is made of a material (for example, fluorine resin, such as PFA or PTFE) having a high hardness as compared with that of the surface layer 410*c* of the first roller 410. The elements of the second roller 420 are structured such that the temperature of the surface of the second roller 420 is higher than that of the surface of the first roller 410. Note that reference numeral 420*d* represents a bearing member for rotatively supporting the second roller 420 on to the frame 430. A separating claw 422, a thermistor 423 and an oil roller 424 are disposed on the outer surface of the second roller 420.

The second roller 420 is pressed against the first roller 410 by an urging means (not shown) so that the second roller 420 follows the first roller 410 and rotates. The separating claw 422 is supported by a shaft 422*b* such that the separating claw 422 is able to swing. The separating claw 422 is urged by a spring 422*c* such that a leading end 422*a* is brought into slidable contact with the outer surface of the second roller 420. Thus, winding of the recording medium S around the second roller 420 is prevented. The thermistor 423 detects the temperature of the surface of the second roller 420. The oil roller 424 is pressed against the second roller 420 so as to follow the second roller 420 and rotate. Thus, a separating agent, such as silicon oil, is applied to the outer surface of the second roller 420.

The foregoing rollers are rotatively supported by the frame 430.

The temperatures of the surfaces of the first and second rollers 410 and 420 are detected by the corresponding thermistors 415 and 423. In accordance with results of the detecting operations, the control unit 80 controls the halogen lamps 411 and 421 such that the temperature of the surface of the second roller 420 is higher than that of the surface of the first roller 410 by a predetermined temperature (for example, about 10 degrees). Also, the rotational speed of the first roller 410 is determined. Thus, the speed at which the recording medium S is conveyed is determined such that the conveying speed at the second and following conveying operations is lower than that at the first conveying speed for the recording medium when the apparatus is operated in the foregoing inverse and re-fixing sub-mode.

The shape of a nipping portion N, in which the first roller 410 and the second roller 420 closely contact with each other, is formed into a recess shape. The recess shape is recessed toward the second roller 420 which is brought into contact with the image forming surface (which is a lower surface in this case) of the recording medium S when the recording medium S finally passes through the fixing unit 400 in the inverse and re-fixing sub-mode when the recess shape is viewed from the axial direction of the nipping portion N. In other words, the hardness of overall body of the second roller 420 is made to be lower than that of the overall body of the first roller 410. Therefore, even if the hardness of the surface layer 420*c* of the second roller 420 is higher than that of the surface layer 410*c* of the first roller 410, the overall body of the nipping portion N is formed into the recess shape recessed toward the second roller 420 as described above.

The frame 430 is provided with a front guide 431 for introducing the recording medium S into the nipping portion N between the first roller 410 and the second roller 420. The frame 430 also includes an upper guide 432, for guiding the recording medium S allowed to pass through the nipping portion N, and a lower guide 433. The upper guide 432 is provided with a guide roller 440. A discharge roller pair 441 and 442 are disposed in the rear of the guide roller 440. The roller 441 is rotated by a drive means (not shown), while the roller 442 is pressed against the roller 441 to follow the roller 441 and rotate.

The recording medium S to which the toner image has been transferred is initially supplied to the nipping portion N between the first roller 410 and the second roller 420. In the nipping portion N, the recording medium S is moved while being heated and applied with pressure in the nipping portion N. During the foregoing process, the non-fixed toner image on the recording medium is fixed to the surface of the recording medium S. Then, the recording medium S is reliably separated from the first roller 410 or the second roller 420 by the separating claw 412 or the separating claw 422, respectively. The recording medium S is then moved to the paper-discharge passage 93.

Figure 8:
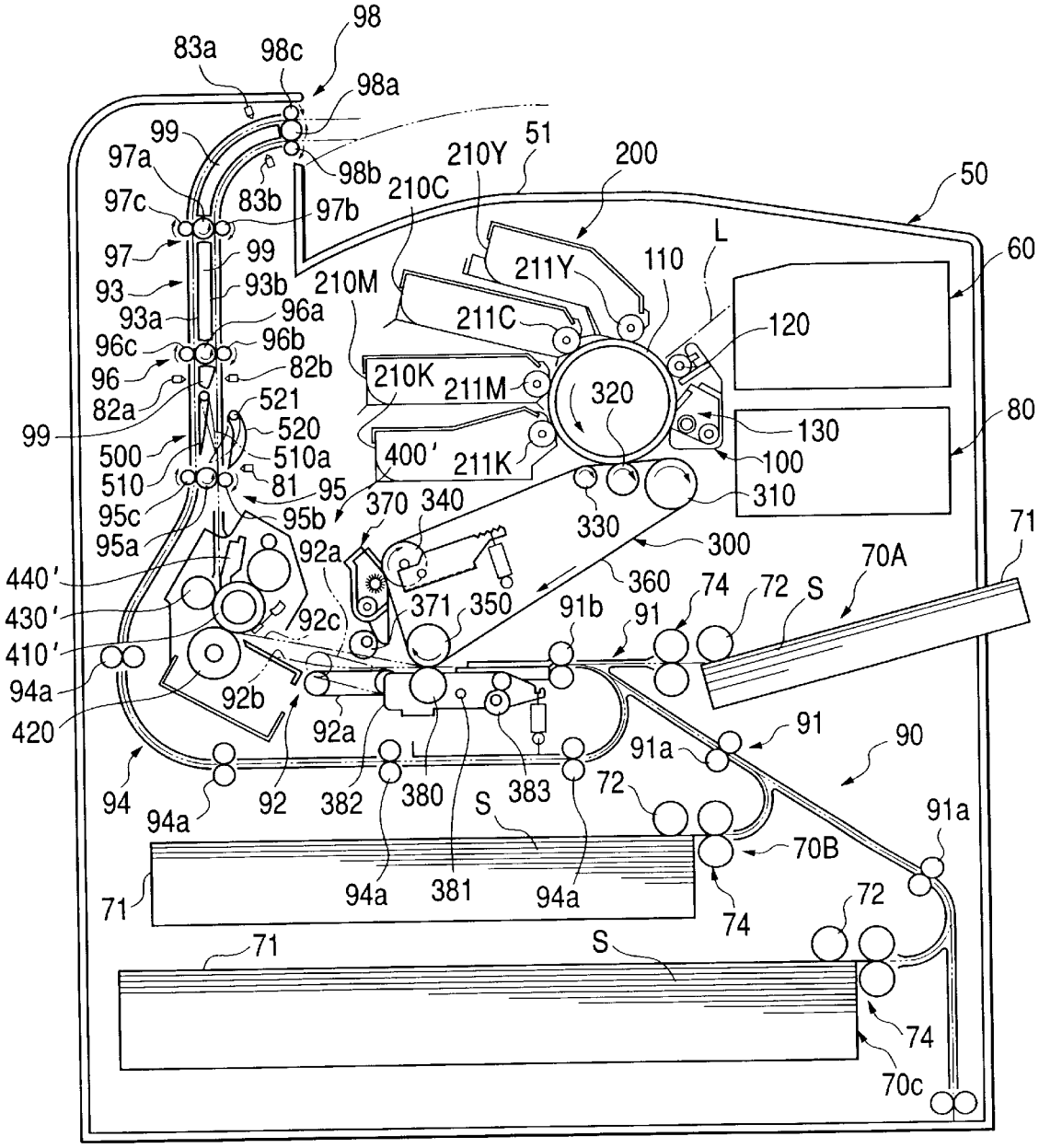
FIG. 8 is a diagram showing the internal structure of a different embodiment of an image forming apparatus according to the present invention which includes a different fixing unit.
Figure 9A:
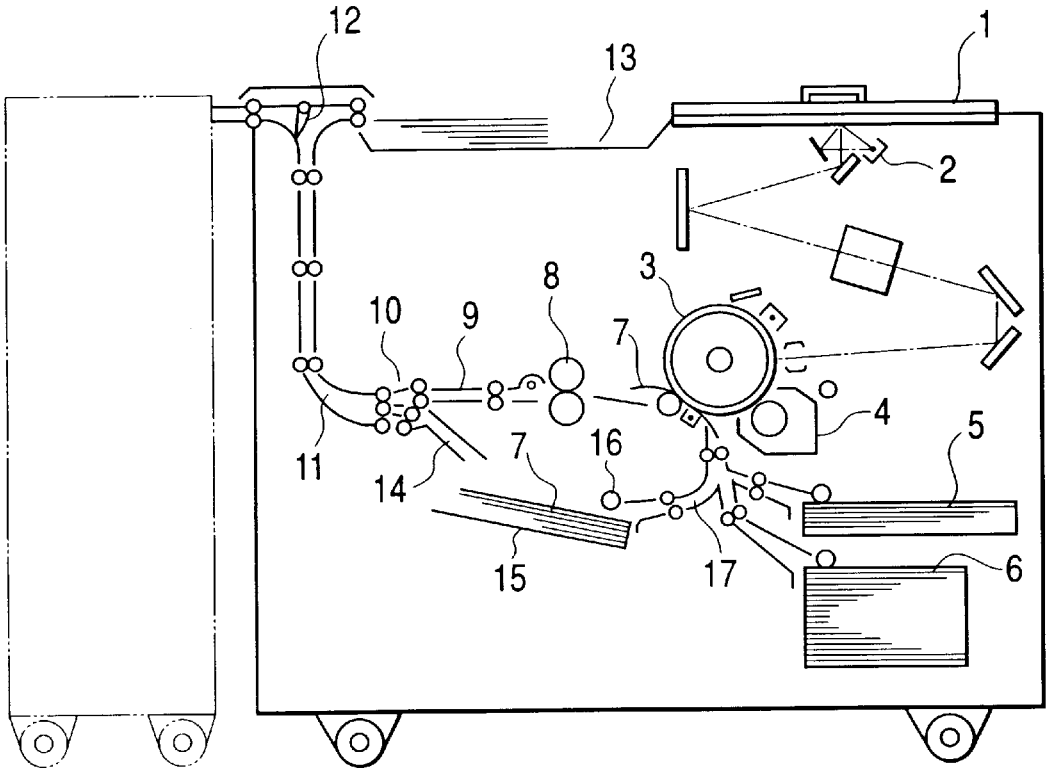
FIGS. 9(*a*) and 9(*b*) are diagrams showing conventional technology.
Figure 9B:
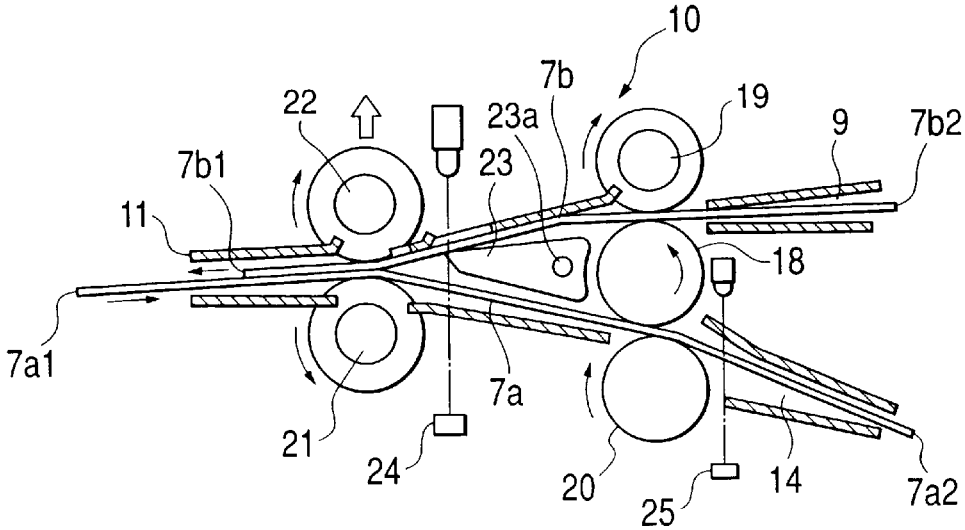

An alternative embodiment of the fixing unit is shown in FIG. 8 as 400'. The rest of the reference numerals in FIG. 8 correspond to similar parts as like reference numerals in FIG. 1. The fixing unit 400' incorporates a heat roller 410 having a heat source, first and second pressing rollers 420' and 430' pressed against the heat roller 410' and a separation claw 440'.

The recording medium S to which the toner image has been transferred is initially supplied to the nipping portion between the heat roller 410' and the first pressing roller 420'. Then, the recording medium S is guided by a guide (not shown) such that the recording medium S is wound around the heat roller 410' so as to be guided to a nipping portion with the second pressing roller 430'. During the above-mentioned process, toner on the recording medium is fixed to the surface of the recording medium. Then, the recording medium is separated from the heat roller 410' by the separation claw 440', and then moved to the paper-discharge passage 93.

The operation of the overall body of the image forming apparatus will now be described. Since the image forming apparatus has either two or three modes as described above, the operation in each mode will now be described.

The image forming apparatus is able to perform an operation for forming images on either side of recording medium (one-side printing) and images on both sides of recording mediums (double-side printing). Therefore, the single-side printing operation will initially be described, and then the double-side printing operation will be described. In either case, an operation which is performed when no paper clogging takes place (in a normal state) will initially be described. Then, an operation which is performed when paper clogging takes place (in a clogging state) will be described.

<Operation in Single-Side Mode>

(in a normal state)

(i) When a print command signal (an image forming signal) has been supplied from a host computer (a personal computer or the like) to the control unit 80, the photosensitive member 110, developing rollers of the developing unit 200, the intermediate transfer belt 360, the first roller 410 and the second roller 420 of the fixing unit and so forth are rotated.

(ii) The outer surface of the photosensitive member 110 is uniformly charged by the charging roller 120.

(iii) The uniformly charged outer surface of the photosensitive member 110 is subjected to selective exposure L corresponding to image information of a first color (for example, yellow) by the exposing unit 60. Thus, an electrostatic latent image for a yellow image is formed.

(iv) Only the developing roller 211Y of the developing unit 210Y for the first color (for example, yellow) is brought into contact with the photosensitive member 110. Thus, the foregoing electrostatic latent image is developed so that a toner image in the first color (for example, yellow) is formed on the photosensitive member 110. [0118]

(v) The toner image formed on the photosensitive member 110 is transferred to the surface of the intermediate transfer belt 360 in the primary transfer portion, that is, a portion between the photosensitive member 110 and the primary transfer roller 320. At this time, the cleaning means 370 and the secondary transfer roller 380 are separated from the intermediate transfer belt 360.

(vi) After toner left on the photosensitive member 110 has been removed by the cleaning means 130, destaticizing light emitted from a destaticizing means (not shown) destaticizes the photosensitive member 110.

(vii) The operations in (ii) to (vi) are repeated as necessary. That is, operations for second, third and fourth colors are repeated in accordance with the contents of the print command signal. Thus, toner images corresponding to the contents of the print command signal are formed and superimposed on the intermediate transfer belt 360.

(viii) A first recording medium S1 is supplied from the paper feeding unit 70 (any one of units 70A, 70B and 70C) through the supply passage 91 and the gate roller pair 91*b* at a predetermined timing. Immediately before the leading end of the recording medium S reaches the second transfer portion or after the same has reached the second transfer portion (that is, when the toner image on the intermediate transfer belt 360 is transferred to a required position on the recording medium S1), the secondary transfer roller 380 is pressed against the intermediate transfer belt 360. Thus, the toner image (basically a full color image) on the intermediate transfer roller 360 is transferred to the recording medium S. Moreover, the cleaning means 370 is brought into contact with the intermediate transfer belt 360 so that toner left on the intermediate transfer belt 360 after the second transfer has been performed is removed.

(ix) The recording medium S to which the toner image has been transferred is allowed to pass through the movable passage 92, and then allowed to pass through the fixing unit 400 so that the toner image is fixed to either side of the recording medium S. Then, the recording medium S is discharged to the receiving portion 51 of the case 50 through the paper-discharge passage 93.

At this time, the first switch guide 510 has been brought to the position denoted by solid lines shown in FIGS. 1 and 2 so that the recording medium S is discharged through the second passage 93*b*.

The operations in (vii) and (viii) are continuously performed as necessary. Therefore, the recording mediums on which images have been formed are sequentially discharged.

The images obtainable form the single-side mode are matted images. Since a non-fixed image on the recording medium S is brought into contact with the first roller 410 having the surface layer 410*c* which is of relatively low hardness and having a relatively low temperature, a matted image having an excellent image quality can easily be obtained.

(In a Case of Paper Clogging)

When recording mediums on each of which an image has been formed, are sequentially discharged through the second passage 93*b*, a recording medium sometimes clogs in the second passage 93*b*. Clogging of the recording medium is detected by photosensors 81, 82*b* and 83*b*.

As described above, the photosensors 81, 82*b*, 83*b* are turned on if a recording medium exists in an opposite position and turned off if no recording medium exists. Therefore, the photosensors are turned on when the leading end of a recording medium passes through the opposite portions, while the photosensors are turned off after the trailing end of a recording medium has passed through the opposite portions.

Therefore, if no clogging takes place and the recording mediums are normally discharged, each sensor is turned on. Then, the sensor is turned off after predetermined time has elapsed (after the trailing end of a recording medium has passed). If a recording medium is clogged, at least one of the photosensors 81, 82*b*, 83*b* is continuously turned on even if the predetermined time has elapsed. The control unit 80 then determines that clogging has taken place.

When clogging has taken place, the control unit 80 detects whether or not the photosensor 81 serving as the inlet-port detection means has been turned off. If the inlet-port detection means 81 is turned off, the control unit 80 determines that the trailing end of the recording medium has been allowed to pass through the inlet portion (of the first conveying roller portion 95 in this case) of the second paper-discharge passage 93*b*. Thus, the control unit 80 operates the solenoid 513 so as to switch the first switch guide 510 to the other paper-discharge passage, that is the first paper-discharge passage 93*a*, as indicated by the imaginary line shown in FIG. 1. Moreover, the separating mechanism is operated so that the following rotations of the follower rollers 96*b*, 97*b* and 98*b* following the corresponding drive rollers in the second and third conveying roller portions 96 and 97 and the paper-discharge roller portion 98 are suspended. Moreover, the foregoing drive rollers are inversely rotated.

Thus, the following recording medium having an image formed thereon and allowed to pass through the fixing unit 400 is introduced into the first paper-discharge passage 93*a*, and then discharged to the receiving portion 51 through the first paper-discharge passage 93*a*. Since the following rotations of the follower rollers 96*b*, 97*b* and 98*b* following the drive rollers have been suspended at this time, inverse movement of the clogged recording medium can be prevented.

If the photosensor 81 is turned on when clogging has occurred, it means that the trailing end of the recording medium has not passed through the inlet port of the second paper-discharge passage 93*b*. That is, the trailing end exists in the inlet portion. Therefore, the control unit 80 does not switch the first switch guide 510 to the position shown in imaginary lines in FIGS. 1 and 2. The control unit 80 instead interrupts the operation of the apparatus, at least, the paper conveying operation. Moreover, a message (alarm sound or display on a display portion of the operation panel) indicating clogging of the recording medium is communicated to a user. Then, the control unit awaits removal of the clogged recording medium by the user after which the control unit 80 again operates the apparatus.

<Operation in Double-Side Printing>

(in a normal case)

The operations in (i) to (vii) are similar to those in the case of the single-side printing operation. Therefore, the operations from (viii) on will now be described in a case where images are formed on both sides of each of three recording mediums.

(viii) A first recording medium S1 is supplied from the paper feeding unit 70 (any one of paper feeding units 70A, 70B and 70C) through the supply passage 91 and the gate roller pair 91*b* at predetermined timing. Similarly to the single-side printing operation, a toner image on the intermediate transfer roller 360 is transferred to the first recording medium S1.

The recording medium S1 to which the toner image has been transferred is allowed to pass through the movable passage 92, and then allowed to pass through the fixing unit 400 so that the toner image is fixed to one side of the recording medium Si.

(ix) Then, a second recording medium S2 is supplied from the paper feeding unit 70 through the supply passage 91 and the gate roller pair 91*b* at a predetermined timing. Thus, the toner image on the intermediate transfer belt 360 is transferred to the surface of the second recording medium S2.

Figure 3:
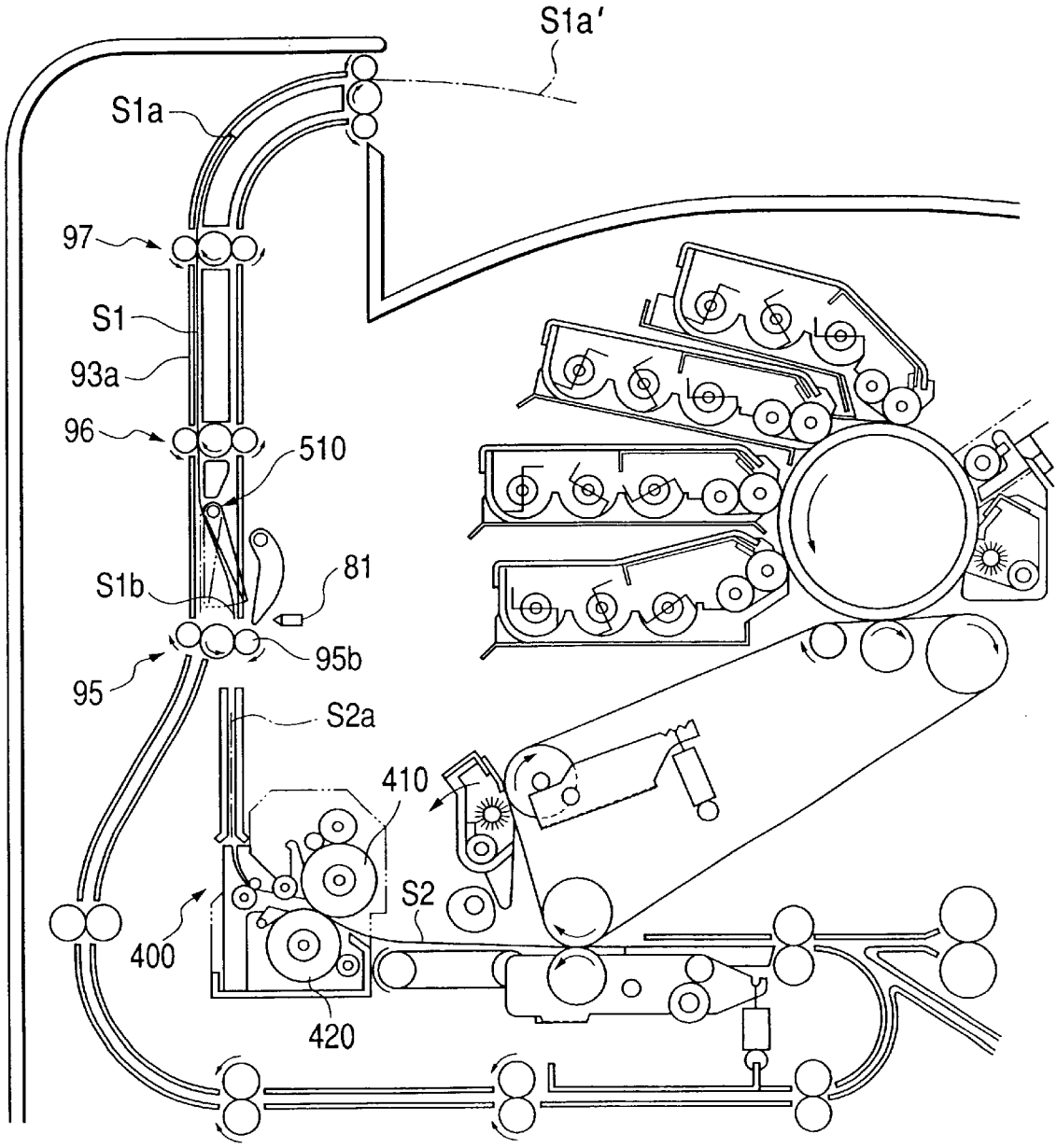
FIGS. 3–6 are diagrams showing the operation of an image forming apparatus according to the prevent invention.

At this time, the first switch guide 510 has been rotated counterclockwise as shown in FIG. 3 such that the leading end 510*a* of the first switch guide 510 is brought to the position facing the second follower roller 95*b*. Therefore, the first recording medium Si is introduced into the first paper-discharge passage 93*a*.

FIG. 3 shows a state immediately after a trailing end S1*b* of the first recording medium S1 has passed through the inlet-portion detection means 81. If the recording medium has a long length, the leading end projects over the paper-discharge roller portion 98 to a position above the receiving portion 51, as indicated with an imaginary line S1'*a* shown in FIG. 3.

At this time, a leading end S2*a* of the recording medium S2 has not reached the first conveying roller portion 95.

Figure 4:
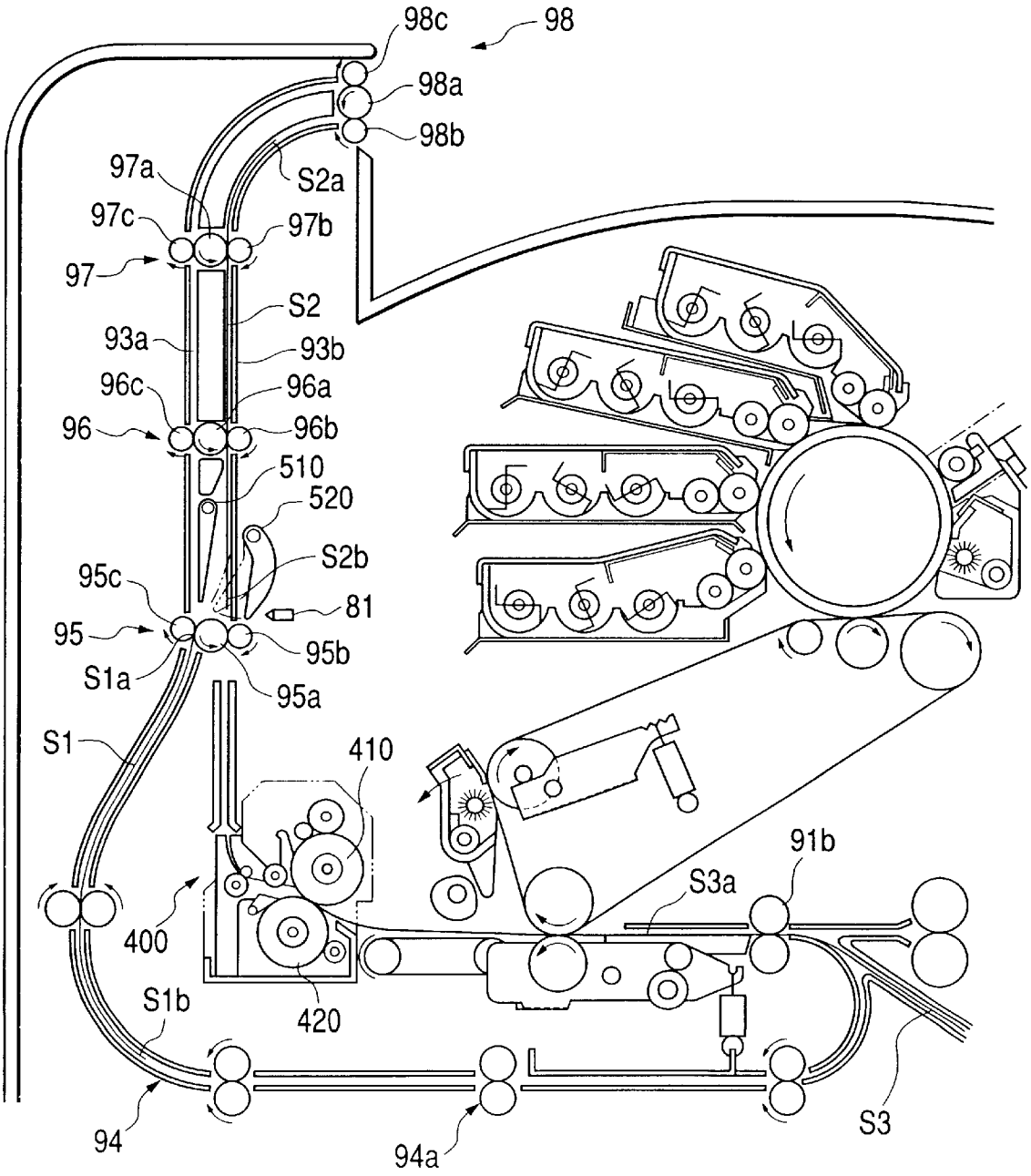

(x) When passage of a trailing end S1*b* of the first recording medium S1 has been detected by the inlet-portion detection means 81, the first switch guide 510 is switched to the first follower roller 95*c*, i.e., clockwise, as indicated with an imaginary line shown in FIG. 3 and a solid line shown in FIG. 4. Moreover, the rotation of the second and third conveying roller portions 96 and 97 and the paper-discharge roller portion 98 are inverted, as shown in FIG. 4.

Therefore, the first recording medium S1 is moved to the returning passage 94 by the drive rollers 95*a*, 96*a*, 97*a* and 98*a* of the first, second and third conveying roller portions 95, 96, 97 and the paper-discharge roller portion 98 (in a case where the recording medium has a long length which is applied hereinafter) and follower rollers 95*c*, 96*c*, 97*c* and 98*c* adjacent to the first paper-discharge passage 93*a*. Moreover, the second recording medium S2 is introduced into the second paper-discharge passage 93*b* by the drive rollers 95*a*, 96*a*, 97*a* and 98*a* of the first, second and third conveying roller portions 95, 96 and 97 and follower rollers 95*b*, 96*b*, 97*b* and 98*b* adjacent to the second paper-discharge passage 93*b*.

At this time, a third recording medium S3 has been supplied from the paper feeding unit 70 at a predetermined timing. A leading end S3*a* of the recording medium S3 has passed through the gate roller pair 91*b*.

(xi) When passage of the trailing end S2*b* of the second recording medium S2 has been detected by the inlet-portion detection means 81, the second switch guide 520 is switched to the first follower roller 95*c*, i.e., clockwise, as indicated with the imaginary line shown in FIG. 4. Moreover, the second and third conveying roller portions 96 and 97 and the paper-discharge roller portion 98 are rotated forwards (rotated in a direction opposite to the direction indicated with the arrow shown in FIG. 4, i.e., with the drive rollers rotating clockwise).

Therefore, the second recording medium S2 is moved to the returning passage 94 by the drive rollers 95*a*, 96*a*, 97*a* and 98*a* of the first, second and third conveying roller portions 95, 96 and 97 and the paper-discharge roller portion 98 and the follower rollers 95*b*, 96*b*, 97*b* and 98*b* adjacent to the second paper-discharge passage 93*b*.

During the above-mentioned process, the second switch guide 520 has been switched to the first follower roller 95*c*, as indicated by the imaginary line shown in FIG. 4. Therefore, the third recording medium S3 is not introduced into the second paper-discharge passage 93*b*. Therefore, the timing at which the third recording medium S3 is supplied has been delayed. That is, the interval from the moment at which supply of the second recording medium S2 is started to the moment at which supply of the third recording medium S3 is started is made to be longer than the interval from the moment at which supply of the first recording medium S1 is started to the moment at which supply of the second recording medium S2 is started.

Figure 5:
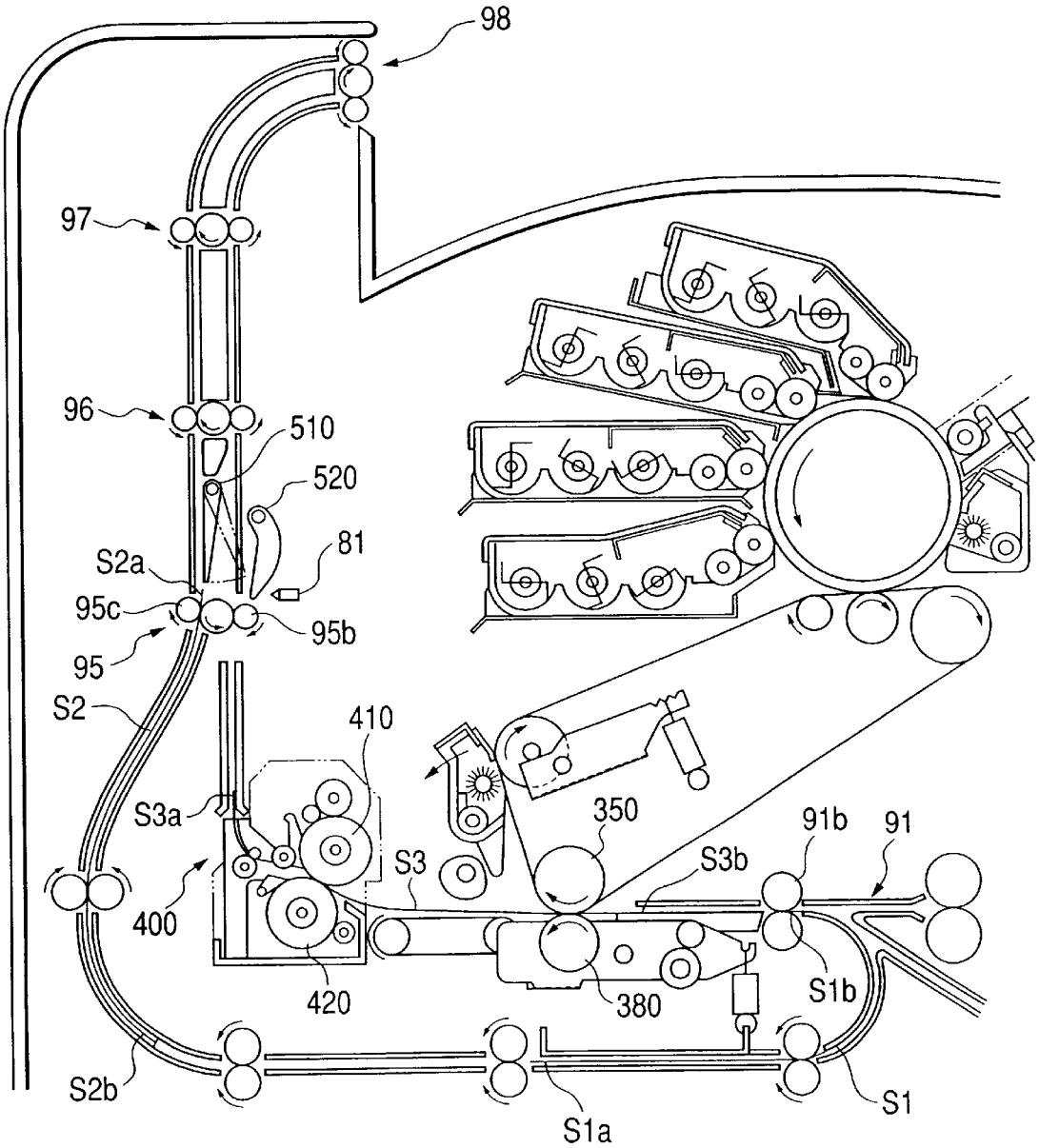

(xii) When passage of the leading end S2*a* (the trailing end in the direction of the movement) of the second recording medium S2 in the returning direction has been detected by the inlet-portion detection means 81, the second switch guide 520 is retracted from the second paper-discharge passage 93*b* as indicated with a solid line shown in FIG. 5, i.e., rotated counterclockwise. Moreover, the first switch guide 510 is rotated counterclockwise as indicated by the imaginary line so as to switch to the second follower roller 95*b*. Moreover, the second and third conveying roller portions 96 and 97 and the paper-discharge roller portion 98 are rotated forwards (rotated in a direction indicated by an arrow shown in FIG. 5, i.e., with the drive rollers rotating counterclockwise).

At this time, the third recording medium S3 is in a state in which an image has been transferred to one side thereof. The trailing end S1*b* (the leading end in the direction of the movement) of the first recording medium S1 is at a position immediately before the gate roller pair 91*b*.

Figure 6:
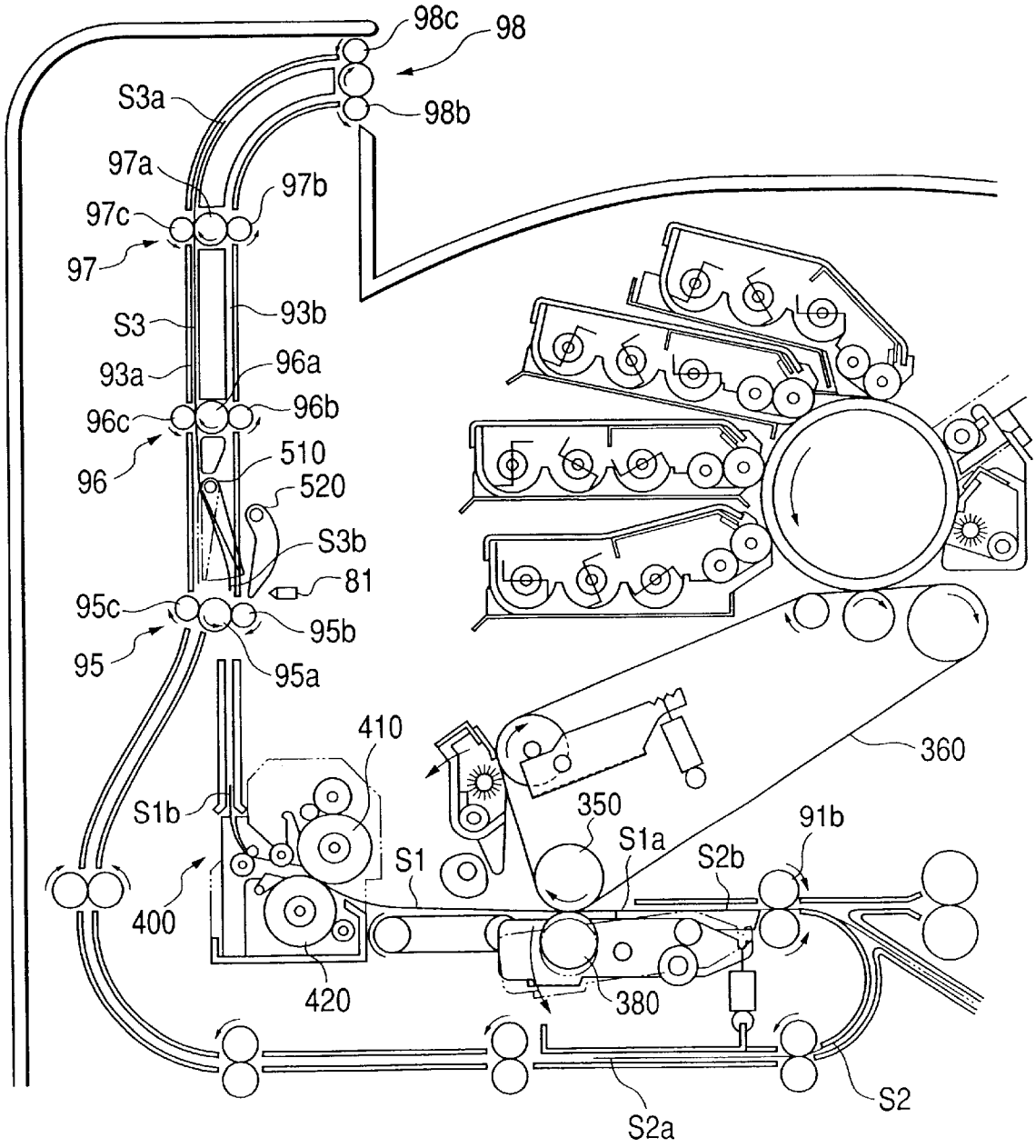

(xiii) When the rollers are continuously rotated, the third recording medium S3 is introduced into the first paper-discharge passage 93*a*, as shown in FIG. 6.

At this time, the first recording medium S1 is positioned such that an image is transferred -to the other side; and the trailing end (the leading end in the direction of the movement) S2*b* of the second recording medium S2 has passed through the gate roller pair 91*b*.

(xiv) When passage of the trailing end S3*b* of the third recording medium S3 is detected by the inlet-portion detection means 81, the first switch guide 510 is switched to the first follower roller 95*c* as indicated by an imaginary line shown in FIG. 6. Moreover, the second and third conveying roller portions 96 and 97 and the paper-discharge roller portion 98 are rotated inversely (rotated in a direction opposite to the direction indicated by the arrow shown in FIG. 6, i.e., with the drive rollers rotating clockwise).

Therefore, the third recording medium S3 is moved to the returning passage 94 by the drive rollers 95*a*, 96*a*, 97*a* and 98*a*, and the follower rollers 95*c*, 96*c*, 97*c* and 98*c* adjacent to the first paper-discharge passage 93*a*, as well as second switch guide 520 which is rotated clockwise by control unit 80. Moreover, the first recording medium S1 is introduced into the second paper-discharge passage 93*b* by the first switch guide 510. After second switch guide 520 is rotated back to the position shown in solid lines in FIG. 4. Then, the first recording medium S1 is moved through the second paper-discharge passage 93*b* by the drive rollers 95*a*, 96*a*, 97*a* and 98*a* as well as the follower rollers 95*b*, 96*b*, 97*b* and 98*b* adjacent to the second paper-discharge passage 93*b*. Then, the first recording medium S1 is discharged to the upper surface of the receiving portion 51 of the case 50.

Subsequently, the second recording medium S2 and the third recording medium S3 are moved through the second paper-discharge passage 93*b*, and then discharged to the upper surface of the receiving portion 51 of the case 50. During the foregoing process, a fourth recording medium is supplied from the paper feeding unit 70 at predetermined timing, and then the foregoing operation is repeated as necessary.

(In a Case of Paper Clogging)

During a process in which recording mediums having images on the two sides thereof are sequentially discharged through the second passage 93*b*, a recording medium (for example, the above-mentioned recording medium S1) sometimes clogs in the second passage 93*b*.

Similarly to the above-mentioned single-side printing operation, the control unit 80, in this case, detects whether or not the photosensor 81 serving as the inlet-port detection means has been turned off. If the inlet-port detection means 81 is turned off, the control unit 80 determines that the trailing end of the recording medium has been allowed to pass through the inlet portion of the second paper-discharge passage 93*b*.

Thus, the control unit 80 switches the first switch guide 510 to the other paper-discharge passage, that is the first paper-discharge passage 93*a*, as indicated by the solid line shown in FIG. 6. Moreover, the separating mechanism is operated so that the following rotations of the follower rollers 96*b*, 97*b* and 98*b* following the corresponding drive rollers suspended. Moreover, the foregoing drive rollers are inversely rotated (rotated in a direction indicated by an arrow shown in FIG. 6).

Thus, the following recording mediums (for example, the recording medium S2 and S3) having images on the two sides thereof and allowed to pass through the fixing unit 400 are introduced into the first paper-discharge passage 93*a*. Then, the recording mediums are allowed to pass through the first paper-discharge passage 93*a*, and are discharged to the receiving portion 51.

In the other cases, the control unit 80 does not switch the first switch guide 510. The control unit 80 interrupts the operation of the apparatus, at least the paper conveying operation. Moreover, the control unit 80 communicates a message (alarm sound or display on the display portion of the operation panel) indicating clogging of the recording medium. Then, removal of the clogged recording medium is waited for, and then the control unit 80 again operates the apparatus.

The above-mentioned image forming apparatus has the first paper-discharge passage 93*a* for discharging, to the receiving portion 51, the recording mediums on which images have been formed, the second paper-discharge passage 93*b* for discharging the recording mediums on which the images have been formed such that the recording mediums are discharged independently from the first paper-discharge passage 93*a* and switching means 510 for introducing the recording mediums, on which images have been formed, to either of the first paper-discharge passage 93*a* or the second paper-discharge passage 93*b*. Therefore, if a recording medium is clogged in the first paper-discharge passage or the second paper-discharge passage, the switching means 510 introduces the recording medium to another paper discharge passage. Thus, the recording mediums, on which images have been formed, can be discharged to the receiving portions without interruption of the image forming operation.

The foregoing image forming apparatus comprises inlet-portion detection means 81 for detecting a fact that the trailing end of the recording medium introduced into the first paper-discharge passage 93*a* or the second paper-discharge passage 93*b* has passed through an inlet portion of the paper-discharge passage; clogging detection means 82*b* for detecting clogging of the recording medium, on which the image has been formed, in the paper discharge passage; and control means 80 for switching the switching means 510 to the other paper discharge passage when clogging of the recording medium has been detected by the clogging detection means and passage of the trailing end of the recording medium has been detected by the inlet-portion detection means 81. Therefore, if a recording medium introduced into the first paper-discharge passage or the second paper-discharge passage clogs such is detected by the detection means 82*b*. When a fact that the trailing end of the recording medium has passed the inlet portion of the foregoing paper discharge passage has been detected by the inlet-portion detection means 81, the control means 80 automatically switches the switching means 510. Thus, the following recording mediums are introduced into the other paper discharge passage to be discharged. Therefore, the following recording mediums each having an image formed thereon can be discharged.

If the foregoing inlet-portion detection means 81 is not provided and therefore the switching means 510 is switched to the other paper discharge passage though the trailing end of the recording medium has not passed the inlet portion of the paper discharge passage, the trailing end of the recording medium exists in the inlet portion (a position adjacent to the inlet portion of the other paper discharge passage) of each paper discharge passage which is the branching portion between the first and second paper-discharge passages. Therefore, there is apprehension that the foregoing trailing end is brought into contact with the leading end of the following recording medium. Therefore, there is apprehension that the following recording medium cannot always and reliably be introduced into the other paper discharge passage.

On the other hand, the image forming apparatus according to this embodiment has the structure that the switching means 510 is switched when the fact that the trailing end of the recording medium is passing the inlet of the paper discharge passage has been detected (or is being detected) if the recording medium introduced into the first paper-discharge passage or the second paper-discharge passage is clogged. Therefore, interference between the trailing end of the clogged recording medium and the following recording medium can be prevented. Thus, the following recording mediums each having an image formed thereon can reliably be introduced into the other paper discharge passage so as to be discharged. The image forming apparatus thus has the structure in which the switching means 510 is automatically switched so as to reliably introduce the following recording mediums into the other paper discharge passage so as to be discharged if a recording medium is clogged in the first paper-discharge passage or the second paper-discharge passage. Therefore, if a recording medium is clogged, images can be formed on the following recording mediums so as to discharge the recording mediums normally.

<Inverse and Re-Fixing Sub-Mode>

The basic operation in this mode is similar to that in the double-side mode. The difference lies in that the recording medium allowed to pass through the fixing unit 400 one time is turned inside out in the paper-discharge passage 93. When the recording medium is again moved to the fixing unit 400 through the returning passage 94, the non-fixed toner image is not transferred to the other surface. Although the other portions are the same, the structure will briefly be described.

The operations in (i) to (vii) are performed as described above. Therefore, the operations from (viii) on will now be described in a case where images are formed on only one side of each of three recording mediums. The operation that one recording medium is allowed to pass through the fixing unit 400 two times in total will now be described.

(viii) A first recording medium S1 is supplied zo from the paper feeding unit 70 through the supply passage 91 and the gate roller pair 91*b* at a predetermined timing. Immediately before the leading end of the first recording medium S1 reaches the second transfer portion or after the same has reached the second transfer portion, the secondary transfer roller 380 is pressed against the intermediate transfer belt 360. Thus, a toner image (basically a full color image) on the intermediate transfer roller 360 is transferred to one side of the first recording medium S1.

The first recording medium S1 to which the toner image has been transferred is allowed to pass through the movable passage 92 and the fixing unit 400 so that the toner image is fixed to either side one time. The image after one fixing operation is the matted image as described above.

(ix) Then, a second recording medium S2 is supplied from the paper feeding unit 70 through the supply passage 91 and the gate roller pair 91*b* at a predetermined timing. Thus, a toner image on the intermediate transfer roller 360 is transferred to one side of the second recording medium S2, and then the second recording medium S2 is conveyed through a first fixing operation which is performed by the fixing unit 400.

At this time, the first switch guide 510 has been rotated counterclockwise as shown in FIG. 3 such that the leading end 510*a* of the first switch guide 510 of the first switch guide 510 is at a position facing the second follower roller 95*b*. Therefore, the first recording medium S1 is introduced into the first paper-discharge passage 93*a*.

Also at this time, the leading end S2*a* of the second recording medium S2 has not reached the first conveying roller portion 95.

(x) When passage of the trailing end S1*b* of the first recording medium S1 has been detected by the inlet-port detection means 81, the first switch guide 510 is switched to the first follower roller 95*c* as indicated by imaginary line shown in FIG. 3 and the solid line shown in FIG. 4. Moreover, the second and third conveying roller portions 96 and 97 and the paper-discharge roller portion 98 are rotated inversely, i.e., such that the drive rollers rotate counterclockwise as shown in FIG. 4.

Therefore, the first recording medium S1 is moved to the returning passage 94 by the drive rollers 95*a*, 96*a*, 97*a* and 98*a* (in a case where the recording medium is long, as described hereinafter) and follower rollers 95*c*, 96*c*, 97*c* and 98*c* adjacent to the first paper-discharge passage 93*a*. Moreover, the second recording medium S2 is introduced into the second paper-discharge passage 93*b* by the drive rollers 95*a*, 96*a*, 97*a* and 98*a* and the follower rollers 95*b*, 96*b*, 97*b* and 98*b* adjacent to the second paper-discharge passage 93*b*.

At this time, a third recording medium S3 has been supplied from the paper feeding unit 70 at predetermined timing such that a leading end S3*a* has passed through the gate roller pair 91*b*.

(xi) When the trailing end S2*b* of the second recording medium S2 has been detected by the inlet-port detection means 81, the second switch guide 520 is switched to the first follower roller 95*c* as indicated by the imaginary line shown in FIG. 4. Moreover, the second and third conveying roller portions 96 and 97 and the paper-discharge roller portion 98 are rotated forwards (rotated in a direction opposite to the direction indicated by the arrow shown in FIG. 4, i.e., such that the drive rollers rotate clockwise).

Therefore, the second recording medium S2 is moved to the returning passage 94 by the drive rollers 95*a*, 96*a*, 97*a* and 98*a* and the follower rollers 95*b*, 96*b*, 97*b* and 98*b* adjacent to the second paper-discharge passage 93*b*.

(xii) When passage of the leading end S2*a* (the trailing end in the direction of movement) in the returning direction has been detected by the inlet-port detection means 81 as shown in FIG. 5, the second switch guide 520 is retracted from the second paper-discharge passage 93*b* as indicated by the solid line. Moreover, the first switch guide 510 is rotated counterclockwise as indicated by the imaginary line as shown in FIG. 5, so as to be switched to the second follower roller 95*b*. Moreover, the second and third conveying roller portions 96 and 97 and the paper-discharge roller portion 98 are rotated forwards (rotated in the direction indicated by the arrow shown in FIG. 5).

At this time, the third recording medium S3 is in a state in which an image has been transferred and fixed to one side thereof. The first recording medium Si is in a state in which the trailing end S1*b* (the leading end in the direction of movement) of the first recording medium S1 is at a position immediately before the gate roller pair 91*b*.

(xiii) After the trailing end S3*b* of the third recording medium S3 has passed through the nipping portion between the backup roller 350 and the secondary transfer roller 380 (that is, after the transfer process has been completed), the backup roller 350 and the secondary transfer roller 380 are separated from each other, as indicated by the imaginary line shown in FIG. 6.

In an alternative embodiment, the speed of conveyance can be varied, instead of varying roller temperatures, to selectively produce matte or glossy images. Thus, in the conveying process from the state shown in FIG. 5 to the state shown in FIG. 6, the rotational speed of the first roller 410, that is, the speed at which the recording medium is conveyed, is switched to low speed after the trailing end S3*b* of the third recording medium S3 is allowed to pass through the nipping portion N between the first roller 410 and the second roller 420 of the fixing unit 400, the speed being switched to the low speed before the trailing end Sb (the leading end in the direction of the movement) of the first recording medium S1 reaches the nipping portion N.

(xiv) Then, rotations of the rollers are maintained so that the third recording medium S3 is introduced into the first paper-discharge passage 93*a*, as shown in FIG. 6.

At this time, the first recording medium S1 is in a state in which no image has been transferred to the other surface of the first recording medium S1. Moreover, the foregoing image on the side (which is the lower surface in this case) has been brought into contact with the second roller 420 so that the first recording medium S1 has been subjected to the second fixing (re-fixing) operation at a relatively high temperature. The second recording medium S2 is in a state in which the trailing end (the leading end in the direction of movement) S2*b* has passed through the gate roller pair 91*b*.

(xv) When passage of the trailing end S3*b* of the 2() third recording medium S3 has been detected by the inlet-portion detection means 81, the first switch guide 510 is switched to the first follower roller 95*c* as indicated by the imaginary line shown in FIG. 6. Moreover, the second and third conveying roller portions 96 and 97 and the paper-discharge roller portion 98 are rotated inversely (rotated in the direction opposite to the direction indicated by the arrow shown in FIG. 6, i.e., such that the drive rollers rotate counterclockwise).

Therefore, the third recording medium S3 is moved to the returning passage 94 by the drive rollers 95*a*, 96*a*, 97*a* and 98*a* and the follower rollers 95*c*, 96*c*, 97*c* and 98*c* adjacent to the first paper-discharge passage 93*a*. Moreover, the first recording medium S1 subjected to the second fixing operation (the re-fixing operation) is introduced into the second paper-discharge passage 93*b* by the first switch guide 510. Then, the first recording medium S1 is moved by the drive rollers 95*a*, 96*a*, 97*a* and 98*a* and the follower rollers 95*b*, 96*b*, 97*b* and 98*b* adjacent to the second paper-discharge passage 93*b*. The first recording medium 51 is thus discharged to the upper surface of the receiving portion 51 of the case 50.

Then, an image on either side of each of the second recording medium S2 and the third recording medium S3 is brought into contact with the second roller 420 so as to be subjected to a second fixing operation at relatively high temperature, and then moved in the second paper-discharge passage 93*b*. Subsequently, the second recording medium S2 and third recording medium S3 are discharged to the upper surface of the receiving portion 51 of the case 50. During the above-mentioned process, a fourth recording medium is supplied from the paper feeding unit 70 at predetermined timing, and then the above-mentioned operation is repeated as necessary.

An image finally obtained in the inverse and re-fixing sub-mode is a glossy image. Since the image on the recording medium is brought into contact with the second roller 420 incorporating the surface layer 420*c* having relatively high hardness and a relatively high temperature, a glossy image having an excellent image quality can easily be obtained.

The image forming apparatus having the above-mentioned structure attains the following operation and effects.

(a) A non-fixed image is formed on the recording medium S by the image forming portion, and then the recording medium S is moved while being heated and applied with pressure by rollers in the fixing unit 400 each having a surface layer. Thus, the non-fixed image is fixed to the recording medium S.

When the mode is the double-side mode, images are formed on both sides of the recording medium S. When the mode is the single-side mode, an image is formed on only one side of the recording medium S.

When the inverse and re-fixing sub-mode is selected in the single-side mode, the recording medium S allowed to pass through the fixing unit 400 one time and is turned inside out. Then, the recording medium S is allowed to again pass through the fixing unit 400. Therefore, accumulation of curls of the recording medium S is prevented.

Also, the image forming apparatus according to this embodiment having the double-side mode and the single-side mode is able to satisfactorily prevent clogging of a recording medium although the recording medium S is allowed to pass through the fixing unit several times in the single-side mode.

The first roller 410 is a roller which is brought into contact with the non-fixed image on the recording medium S when the recording medium S is allowed to pass through the fixing unit 400 a first time. The second roller 420 is a roller which is brought into contact with an image on the recording medium S when the recording medium S is allowed to pass through the fixing unit 400 a second time. Since the hardness of the surface layer 420*c* of the second roller 420 is higher than that of the surface layer 410*c* of the first roller 410, a matted image or a glossy image having an excellent image quality can selectively be obtained.

More specifically, the foregoing image forming apparatus is arranged to obtain a matted image such that a recording medium S having a non-fixed image formed in the single-side mode (except for the inverse and re-fixing sub-mode) is allowed to pass through the fixing unit 400 one time. Since the non-fixed image on the recording medium S is brought into contact with the first roller 410 incorporating the surface layer 410*c* having relatively low hardness, a somewhat rough state realized by toner particles which have not been completely melted is left on the surface of the image. Therefore, a matted image having an excellent image quality is obtained. When the recording medium S is plain paper or bond paper having rough surfaces and a matted image is attempted to be formed on the surface of the foregoing recording medium S, deformation of the cross sectional shape of the toner image on the recording medium must be prevented. As an alternative to this, the toner image must be fixed along the shape of the fiber in the paper.

When a glossy image is desired, the recording medium S having the non-fixed image formed in the inverse and re-fixing sub-mode is allowed to pass through the fixing unit 400 one time so that a matted image is formed. Then, the recording medium S is turned inside out, and then allowed to again pass through the fixing unit 400 at least one (two or more times in total) time. Therefore, a relatively large quantity of heat is supplied so that the matted image is formed into a glossy image. Thus, the glossy image is obtained. Since the matted image on the recording medium S is brought into contact with the second roller 420 incorporating the surface layer 420*c* having relatively high hardness, the surface of the toner image which has completely melted can be smoothed. As a result, a glossy image having an excellent image quality is obtained.

When the recording medium S is an OHP sheet, glossy paper or paper for only a color image (a special sheet having the surface of a sheet-shape base member (PET or paper) coated with a thermoplastic resin which serves as an image receiving layer), the toner image on the recording medium must be smoothed simultaneously with melting or embedded in the image receiving layer. Thus the foregoing image forming apparatus having the inverse and re-fixing sub-mode causes the matted image on the recording medium S to be brought into contact with the second roller 420 incorporating the surface layer 420*c* having relatively high hardness when the recording medium S is allowed to again pass through the fixing unit 400. Therefore, the surface of the toner image which has completely been melted can be smoothed or embedded in the image receiving layer. As a result, a glossy image having an excellent image quality is obtained.

As described above, the image forming apparatus according to this embodiment having the double-side mode and the single-side mode is able to satisfactorily prevent clogging of the recording medium S although the recording medium S can be allowed to pass through the fixing unit 400 several times when the mode is the single-side mode. Moreover, a matted image or a glossy image having an excellent image quality can selectively be obtained.

(b) Because the surface layer 420*c* of the second roller 420 is made of the resin having a separating characteristic, winding of the recording medium S around the second roller 420 which takes pace in the inverse and re-fixing sub-mode is satisfactorily prevented. Therefore, the quantity of the separating agent which must be applied to the surface of the second roller 420 can be reduced. When the recording medium is an OHP sheet, deterioration in the transparency and color developing characteristic occurring because of the separating agent is prevented. Thus, a glossy image having satisfactory transparency and a color developing characteristic is obtained.

(c) Since the temperature of the surface of the second roller 420 is higher than that of the surface of the first roller 410, a matted image or a glossy image having an excellent image quality can selectively be obtained.

Specifically, the foregoing image forming apparatus is able to obtain a matted image such that a recording medium S having a non-fixed image formed in, for example, the single-side mode (except for the inverse and re-fixing sub-mode), is allowed to pass through the fixing unit 400 one time. Since the non-fixed image on the recording medium S is brought into contact with the first roller 410 having relatively low temperature, a matted image having an excellent image quality is easily obtained.

When a glossy image is desired, the recording medium S having a non-fixed image formed in the inverse and re-fixing sub-mode is allowed to pass through the fixing unit 400 one time. Thus, a matted image is formed, and then the recording medium S is turned inside out. Subsequently, the recording medium S is allowed to pass through the fixing unit 400 at least one more time (two or more times in total) so that a relatively large quantity of heat is supplied. Thus, the matted image is formed into a glossy image. As a result, a glossy image is obtained. Since the matted image on the recording medium S is brought into contact with the second roller 420 having a relatively high temperature, a glossy image having an excellent image quality can easily be obtained.

When the recording medium is allowed to pass through the fixing unit at the second or following time, the recording medium has been allowed to pass through the fixing unit 400 one time. Since the developer, such as toner, is melted to a degree with which the matted image can be obtained at the first fixing operation, cohesive force between developers and the bonding strength between the developer and the recording medium have considerably been enlarged as compared with those of the non-fixed image. Therefore, even if a large quantity of heat is supplied by the second roller 420 having the relatively high temperature, offset does not easily take place.

Therefore, the foregoing image forming apparatus has a structure in which a glossy image is obtained, in particular, a color image, is obtained by supplying a great quantity of heat by the second roller 420. Therefore, an excellent image quality glossy image having satisfactory color developing characteristic, transparency and luster can be obtained.

In particular, a satisfactory effect can be obtained when the recording medium is an OHP sheet, glossy paper or paper for only a color image (a special sheet having the surface of a sheet-shape base member (PET or paper) coated with a thermoplastic resin which serves as an image receiving layer).

Moreover, a glossy image having an excellent image quality can easily be obtained even if the number of the fixing operations is very small.

As described above, the image forming apparatus according to this embodiment having the double-side mode and the single-side mode is able to satisfactorily prevent clogging of the recording medium S although the recording medium S can be allowed to pass through the fixing unit 400 several times when the mode is the single-side mode. Moreover, a matted image or a glossy image having an excellent image quality can selectively be obtained.

Thus, reduction in the speed at which the recording medium is allowed to pass through the fixing unit is not required as has been required for the conventional technology disclosed in Japanese Patent Publication No. 6-40235. Therefore, a glossy image having an excellent image quality can be obtained at relatively high speed.

(d) A non-fixed image is formed on the recording medium S by the image forming portion, and then the recording medium S is moved while being heated and applied with pressure by rollers in the fixing unit 400 wherein each roller has a surface layer. Thus, the non-fixed image is fixed to the recording medium S. The fixing operations are performed selectively by conveying the recording mediums a plurality of times.

When the recording medium S is allowed to pass through the fixing unit 400 plural times, the conveying speed of the recording medium S, realized by the fixing unit 400, is made lower in the second and following fixing operations as compared with that of the first conveying operation. Therefore, a glossy image having excellent image quality can easily be obtained. Thus, the foregoing image forming apparatus enables the glossy image to be obtained by causing the recording medium S having a non-fixed image formed thereon to be allowed to pass through the fixing unit 400 one time at a relatively low speed.

Specifically to obtain a glossy image, the recording medium S having a non-fixed image formed thereon is allowed to pass through the fixing unit 400 one time at relatively high speed so that a matted image is formed. The second and following fixing operations are performed by allowing the same recording medium to pass through the fixing unit 400 at relatively low speed so that a great quantity of heat is supplied. Thus, the matted image is formed into a glossy image. As a result, a glossy image having high quality is obtained.

When the recording medium is allowed to pass through the fixing unit 400 at the second and following operations, the recording medium S has already been allowed to pass through the fixing unit 400 one time. Since toner is melted to a degree with which the matted image can be obtained at the first fixing operation, cohesive force between toner and the bonding strength between the toner and the recording medium have considerably been enlarged as compared with those of the non-fixed image. Therefore, even when a large quantity of heat is supplied as a result of the relatively low conveying speed, offset does not easily take place.

Therefore, the foregoing image forming apparatus has the structure that a glossy image is obtained, in particular, a color image, by supplying a great quantity of heat. Therefore, an excellent image quality glossy image having satisfactory color developing characteristic, transparency and luster can be obtained. In particular, a satisfactory effect can be obtained when the recording medium is an OHP sheet, glossy paper or paper for only a color image (a special sheet having the surface of a sheet-shape base member (PET or paper) coated with a thermoplastic resin which serves as an image receiving layer).

Therefore, a glossy image having an excellent image quality can easily be obtained even if the number of the fixing operations is very small.

As described above, the image forming apparatus according to this embodiment enables a matted image or a glossy image having an excellent image quality to be selectively and easily obtained.

(e) When the recording medium S is allowed to pass through the fixing unit 400 plural times, the recording medium S is allowed to pass through the fixing unit 400 one time. Then, the recording medium S is turned inside out so as to be allowed to pass through the fixing unit 400 so that the second and following passages are performed. Therefore, accumulation of curls of the recording medium S can be prevented although the recording medium S is allowed to pass through the fixing unit a plurality of times. Therefore, clogging of the recording medium S is satisfactorily prevented.

(f) The fixing unit 400 incorporates the first and second rollers 410 and 420 for conveying the recording medium S having a non-fixed image formed thereon while heating and applying pressure to the recording medium S. Moreover, in a case where the recording medium having an image formed on either side thereof is allowed to pass through the fixing unit 400 a plurality of times the shape of a nipping portion between the first and second rollers 410 and 420 is formed into a recess facing a roller (which is the second roller 420 in this case) which is brought into contact with an image forming surface of the recording medium, which is allowed to finally pass through the fixing unit 400 when the recess is viewed from an axial direction of the recess. Therefore, when the recording medium S is finally allowed to pass through the fixing unit 400, the recording medium S is moved in a direction facing a direction apart from the surface of the second roller 420 which is brought into contact with the image forming surface.

Therefore, undesirable winding of the recording medium around the foregoing roller can satisfactorily be prevented. As a result, the recording medium S is smoothly moved.

(g) The inverse and re-fixing sub-mode is a mode in which the recording medium S is allowed to pass through the fixing unit 400 an even number of times. Moreover, the shape of the nipping portion N between the first and second rollers 410 and 420 of the fixing unit 400 is recessed toward the face of the second roller 420 when the recess shape is viewed from the axial direction of the nipping portion N. Therefore, when the recording medium S is allowed to pass through the fixing unit 400 the final time, the recording medium S is directed in a direction apart from the surface of the second roller 420 which is brought into contact with the image forming surface of the recording medium S.

Therefore, undesirable winding of the recording medium S around the second roller 420, the temperature of which is relatively high, can satisfactorily be prevented. As a result, the recording medium S is smoothly moved.

The foregoing effect will now be described.

That is, the structure according to this embodiment is formed such that when the recording medium S is allowed to pass through the fixing unit 400 a first time, the image forming surface (the upper surface in this case) of the recording medium S is brought into contact with the first roller 410. Since the shape of the nipping portion is formed as described above, the recording medium S is fed in such a manner that the recording medium S is directed to approach the surface of the first roller 410 which is brought into contact with the image forming surface (the feeding angle is indicated by θ1 shown in FIG. 7). However, the quantity of heat which is supplied to the recording medium S and toner at the first fixing operation is relatively small as compared with the quantity of heat which is supplied when the fixing operation is performed two times. Since the temperature of the first roller 410 is relatively low, toner is not excessively melted. Therefore, even if the shape of the nipping portion N is formed as described above, the recording medium S is not easily wound around the first roller 410 at the first fixing operation.

When the second fixing operation is performed, a relatively large quantity of heat is supplied to the recording medium S and toner as compared with the quantity of heat which is supplied when the first fixing operation is performed Since the temperature of the second roller 420 is relatively high, toner is easily melted as compared with the first fixing operation. Therefore, if the shape of the nipping portion is not formed as described above, the recording medium S is easily wound around the second roller 420 at the second fixing operation. The above-mentioned relationship can be applied to the third and fourth fixing operations.

However, the structure according to this embodiment has the arrangement wherein the shape of the nipping portion N between the first and second rollers 410 and 420 is formed into a recess shape when viewed in the axial direction. The nipping portion N is recessed to face the fixing unit 400 which is brought into contact with the image forming surface of the recording medium S when the recording medium S is allowed to finally (at the even numbered times) pass through the fixing unit 400 in the inverse and re-fixing sub-mode. Therefore, when the recording medium S is allowed to finally pass through the fixing unit 400, the recording medium S is fed such that the recording medium S is directed to a direction apart from the surface of the second roller 420 which is brought into contact with the image forming surface (the feeding angle is indicated by θ2 shown in FIG. 7). Hence, undesirable winding of the recording medium S around the foregoing roller can satisfactorily be prevented. Thus, a state in which the recording medium S is furthermore smoothly moved can be realized.

Therefore, the quantity of the separating agent which is applied to the second roller 420 can be reduced. As a result, the transparency and the color developing characteristic of the image on the OHP sheet can be improved.

When paper is employed as the recording medium, water in the paper is evaporated at the first fixing operation and thus the paper is dried. Therefore, the paper is firmed so that winding of the paper around the second roller 420 can furthermore satisfactorily be prevented at the re-fixing operation. The structure is arranged such that the first roller 410 is applied with a separating agent. Since the image forming surface of the recording medium S is coated with the separating agent at the first fixing operation, winding around the second roller 420 at the re-fixing operation can furthermore satisfactorily be prevented. If toner containing a separating agent, such as any one of a variety of waxes, is employed, the separating agent eluted from toner at the first fixing operation is solved out and moved to the surface of the image. Therefore, winding of the recording medium S around the second roller 420 at the re-fixing operation can furthermore satisfactorily be prevented.

(h) Since the inverse and re-fixing sub-mode can be selected in accordance with the type of the recording medium or the type of the image quality obtainable after the fixing operation has been completed, images of a variety of image qualities can be obtained to correspond to various recording mediums when an image is formed on only one side of the recording medium in the single-side mode.

(i) The inverting and returning passages 93 and 94 are provided which turn inside out the recording medium S allowed to pass through the fixing unit 400 one time in the double-side mode and again return the recording medium S to the image forming portion. The m0 inverting and returning passages 93 and 94 are employed as passages for turning inside out the recording medium S and again returning the recording medium S to the fixing unit 400 in the inverse and re-fixing sub-mode. Therefore, the structure of the paper conveying passage can be simplified and the size of the apparatus can be reduced.

(j) Since the inverting and returning passages 93 and 94 have lengths capable of accommodating a plurality of the recording mediums S, no intermediate tray is required in the double-side mode to efficiently form images on the both sides of the recording medium S. Moreover, clogging of the recording medium S in the inverse and re-fixing sub-mode can furthermore satisfactorily be prevented. Since the intermediate tray is not required, the size of the apparatus can be reduced.

The image forming apparatus according to one embodiment incorporates the inverting and returning passages 93 and 94 having lengths capable of accommodating a plurality of recording mediums S. Therefore, no intermediate tray is required in the double-side mode to efficiently form images on both sides of the recording medium S. Since no intermediate tray is required, the problems associated with Japanese Patent Publication No. 6-68646 do not arise. Therefore, clogging of the recording medium S in the inverse and re-fixing sub-mode are furthermore satisfactorily prevented. Since the intermediate tray is not required, the size of the apparatus can be reduced.

(k) The apparatus according to this embodiment incorporates an image forming portion for forming an image on a recording medium; the first and second passages 93*a* and 93*b* into which the recording medium on which the image has been formed on either side thereof by the image forming portion or from which the same is discharged; the guide means 99 and 510 disposed between the first passage 93*a* and the second passage 93*b* and arranged to make the first passage 93*a* and the second passage 93*b* completely separate and independent passages; the introducing and discharging means 95 and 510 disposed at the inlet portions of the first and second passages and arranged to introduce the recording medium moved from the image forming portion into the first passage or the second passage and discharge the introduced recording medium; and the returning passage 94 for returning the recording medium discharged from the introducing and discharging means to the image forming portion. Thus, the recording medium having an image formed on either side thereof by the image forming portion is temporarily introduced into the first passage or the second passage by the introducing and discharging means, and then is discharged. The discharged recording medium is allowed to pass through the returning passage 94, and then returned to the image forming portion and the fixing unit 400. Thus, an image can be formed on the other side, or re-fixed.

The recording medium having an image formed on either side thereof is introduced into the first passage or the second passage or discharged. Therefore, discharge of the recording medium from the first passage 93*a* and introduction of the recording medium into the second passage 93*b* can simultaneously be performed. The image forming apparatus according to this embodiment incorporates the guide means 99 and 510 disposed between the first passage 93*a* and the second passage 93*b*. The foregoing guide means makes the first passage 93*a* and the second passage 93*b* completely separate and independent passages.

Therefore, contact between the recording mediums introduced into the first passage or the second passage or discharged from the same can be prevented. Therefore, the foregoing image forming apparatus is able to prevent the right surface and the reverse surface of the recording mediums from contamination.

(l) The receiving portion 51 for receiving the recording medium on which an image has been formed and discharged by the image forming portion is provided. Moreover, the first and second passages 93*a* and 93*b* are formed into the first and second paper-discharge passages 93*a* and 93*b* which are capable of independently discharging the recording medium having an image formed thereon. Therefore, the recording medium introduced into the first passage or the second passage can be moved to the returning passage 94 or discharged to the receiving portion 51.

The recording medium which is introduced into the first passage or the second passage or discharged from the same is guided by the guide means 99 and 510. Since the foregoing recording medium is not guided by the preceding recording medium, clogging of a recording medium is prevented.

That is, the image forming apparatus according to this embodiment is able to form images on both sides of recording mediums. Moreover, contamination of the two sides of the recording mediums is prevented and clogging of a recording medium is prevented.

That is, movement of the recording medium, in either the first passage 93*a* or the second passage 93*b* to the returning passage 94 or discharge to the receiving portion 51 can be selected. Therefore, freedom in the operation mode of the apparatus is widened.

(m) The introducing and discharging means mainly composed of the first conveying roller portion 95 is the means capable of simultaneously introducing and discharging the recording mediums. Moreover, the second and third conveying roller portions 96 and 97 and the paper-discharge roller portion 98, capable of moving the recording medium into the introducing direction and simultaneously moving another recording medium in the discharging direction, are disposed downstream of the introducing and discharging means. Therefore, introduction and discharge of the recording medium can furthermore reliably be performed. As a result, the rate of occurrence of clogging of recording mediums can furthermore be lowered.

Also, because the first and second passages are composed of the first and second paper-discharge passages 93*a* and 93*b*, the space in the apparatus is effectively used.

(n) The introducing and discharging means incorporates the drive roller 95*a* disposed between the first passage 93*a* and the second passage 93*b*; the first follower roller 95*c* pressed against the drive roller 95*a* at a position adjacent to the first passage 93*a*; a second follower roller 95*b* pressed against the drive roller 95*a* at a position adjacent to the second passage 93*b*; and the first switch guide 510 rotatable about the shaft 511 disposed between the first passage 93*a* and the second passage 93*b* and having the leading end 510*a* which faces the first follower roller 95*c* or the second follower roller 95*b*. Therefore, the recording medium which must be introduced into the first passage 93*a* or the second passage 93*b* can reliably be guided by the first switch guide 510.

(o) The second and third conveying roller portions 96 and 97 and the paper-discharge roller portion 98 have the drive rollers 96*a*, 97*a* and 98*a* disposed between the first passage 93*a* and the second passage 93*b*; the first follower rollers 96*c*, 97*c* and 98*c* pressed against the foregoing drive rollers at positions adjacent to the first passage 93*a*; and second follower rollers 96*b*, 97*b* and 98*b* pressed against the foregoing drive rollers at positions adjacent to the second passage 93*b*. Therefore, the structure of the conveying means is simplified and the interior space saved.

(p) A non-fixed image is formed on the recording medium S by the image forming portion, and then the recording medium S is moved while being heated and applied with pressure by the fixing unit 400. Thus, the non-fixed image is fixed to the recording medium S. When the mode is the double-side mode, images are formed on both sides of the recording medium S. When the mode is the single-side mode, an image is formed on only one side of the recording medium S.

When the inverse and re-fixing sub-mode is selected in the single-side mode, the recording medium S allowed to pass through the fixing unit 400 one time is turned inside out. Then, the recording medium S is allowed to again pass through the fixing unit 400 at least one time. Finally, the recording medium S is allowed to pass an even number of times (two times in this embodiment). Therefore, accumulation of curls of the recording medium S is prevented.

That is, the image forming apparatus according to this embodiment having the double-side mode and the single-side mode is able to satisfactorily prevent clogging of a recording medium although the recording medium S passes through the fixing unit several times in the single-side mode.

Moreover, the shape of a nipping portion N between the first and second rollers 410 and 420 of the fixing unit 400 is formed into a recess which when viewed from the axial direction faces a roller (which is the second roller 420 in this case) that is brought into contact with an image forming surface (the lower surface) of the recording medium S which is allowed to finally pass through the fixing unit 400 in the inverse and re-fixing sub-mode. Therefore, when the recording medium is finally allowed to pass through the fixing unit 400, the recording medium S is moved such that the recording medium S faces a direction in which the recording medium S is separated from the surface of the roller 420 which is brought into contact with the image forming surface of the recording medium.

Therefore, winding of the recording medium S around the second roller 420 is satisfactorily prevented. As a result, the recording medium S is smoothly conveyed.

The foregoing effect will now be described. The structure according to this embodiment is formed such that the recording medium S is allowed to pass through the fixing unit 400 a first time, the image forming surface (the upper surface in this case) of the recording medium S is brought into contact with the first roller 410. Since the shape of the nipping portion is formed as described above, the recording medium S is fed in such a manner that the recording medium S is directed to approach the surface of the first roller 410 which is brought into contact with the image forming surface (the feeding angle is indicated by θ1 shown in FIG. 7). However, the quantity of heat which is supplied to the recording medium S and toner at the first fixing operation is relatively small as compared with the quantity of heat which is supplied when the fixing operation is performed two times. Therefore, toner is not excessively melted. Thus, even if the shape of the nipping portion N is formed as described above, the recording medium S is not easily wound around the first roller 410 at the first fixing operation.

When the second fixing operation is performed, a relatively large quantity of heat is supplied to the recording medium S and toner, as compared with the quantity of heat which is supplied when the first fixing operation is performed. Therefore, toner is furthermore smoothly melted as compared with the first fixing operation. Therefore, if the shape of the nipping portion N is not formed as described above, the recording medium S is easily wound around the second roller 420 at the second fixing operation.

Subsequent fixing operations are performed in the same manner as above described with respect to the first and second fixing operations, as necessary.

Further, the structure according to this embodiment has the arrangement that the shape of the nipping portion N between the first and second rollers 410 and 420 of the fixing unit 400 is formed into a recess shape when viewed in the axial direction. The nipping portion N is recessed to face the fixing unit 400 which is brought into contact with the image forming surface of the recording medium S when the recording medium S is allowed to finally (at the even number of times) pass through the fixing unit 400 in the inverse and re-fixing sub-mode. Therefore, when the recording medium S is allowed to finally pass through the fixing unit 400, the recording medium S is fed such that the recording medium S is directed to a direction apart from the surface of the second roller 420 which is brought into contact with the image forming surface (the feeding angle is indicated by 02 shown in FIG. 7). Therefore, undesirable winding of the recording medium S around the foregoing roller is satisfactorily prevented. Thus, the recording medium S is furthermore smoothly conveyed.

Therefore, the quantity of the separating agent which is applied to the second roller 420 can be reduced. As a result, the transparency and the color developing characteristic of the image on the OHP sheet can be improved.

When paper is employed as the recording medium, water in the paper is evaporated at the first fixing operation and thus the paper is dried. Therefore, the paper is firmed so that winding of the paper around the second roller 420 can furthermore satisfactorily be prevented at the re-fixing operation. The structure is arranged such that the first roller 410 is applied with the separating agent. Since the image forming surface of the recording medium S is coated with the separating agent at the first fixing operation, winding around the second roller 420 at the re-fixing operation can furthermore satisfactorily be prevented. If toner containing a separating agent, such as any one of a variety of waxes, is employed, the separating agent eluted from toner at the first fixing operation is solved out and moved to the surface of the image. Therefore, winding of the recording medium S around the second roller 420 at the re-fixing operation can furthermore satisfactorily be prevented.

Specific examples of some of the parts of the image forming apparatus will now be described.

<First Roller 410>

The diameter is about 60 mm.

The hardness of the roller is about 30 degrees to about 80 degrees (JIS A applied to hereinafter), preferably about 48 degrees.

The core member 410*a* is an aluminum pipe having a wall thickness of about 3 mm.

The material of the elastic layer 410*b* is silicon rubber having a thickness L=about 0.2 mm to 5 mm, preferably L=about 1 mm. The heat conductivity $\alpha(\times 10^{-3}$ cal/cm·sec·° C) satisfies $\alpha$=about 0.5 to about 2, preferably $\alpha$=about 1.5. The heat resistance ($L/\alpha$) is about 10 to about 10000, preferably about 67.

The material of the surface layer 410*c* is silicon rubber having a thickness of about 70 $\mu$m and hardness of about 25 degrees. The surface roughness is about 0.15 $\mu$m.

The temperature of the surface of the first roller 410 is about 170° C.

The quantity of oil which is applied to the surface of the first roller 410 is about 0.016 to about 0.0016, preferably about 0.005 (mg/cm$^2$).

<Second Roller 420>

The diameter is about 60 mm.

The hardness of the roller is about 20 degrees to about 70 degrees (JIS A applied to hereinafter), preferably about 40 degrees.

The core member 420*a* is an aluminum pipe having a thickness of about 3 mm.

The material of the elastic layer 420*b* is silicon rubber having a thickness L=about 0.5 mm to 10 mm, preferably L=about 5 mm. The heat conductivity $\alpha(\times 10^{-3}$ cal/cm·sec·° C) satisfies $\alpha$=about 0.5 to about 2, preferably $\alpha$=about 1.0. The heat resistance ($L/\alpha$) is about 25 to about 20000, preferably about 500.

The surface layer 420*c* is in the form of a fluorine resin tube (a PFA tube) having a thickness of about 50 $\mu$m and hardness of about 90 degrees or higher. The surface roughness is about 0.15 $\mu$m.

The temperature of the surface of the second roller 420 is about 180° C.

The quantity of oil which is applied to the surface of the second roller 420 is about 0.0016 to about 0.00016, preferably about 0.0005 (mg/cm$^2$).

<Speed at which Recording Medium is Conveyed by First and Second Rollers 410 and 420>

The first conveying speed (the conveying speed at the first fixing operation) in the inverse and re-fixing sub-mode is made to be about 180 mm/second. The second conveying speed (the conveying speed at the second and following fixing operations) is made to be about ½ to about 1/20 of the first conveying speed, preferably about 1/10.

<Oil Rollers 414 and 424>

Each oil roller has an oil retention layer made of heat resisting fiber (felt or the like) or sponge which can be impregnated with offset-preventive solution (silicon oil or the like) having appropriate viscosity. Moreover, an application-quantity-limiting layer made of a porous film made of tetrafluoroethylene or the like is formed on the surface of the oil retention layer.

The quantity of oil which is applied (the quantity of the same which is discharged) can be adjusted by adjusting the viscosity of oil, diameters of pores of the porous film and density.

<Oil Roller 414 with respect to First Roller 410>

The diameter is about 30 mm.

Oil is dimethyl silicon oil having viscosity (cst) of about 1000.

The quantity of oil which is applied to the surface of the first roller 410 is about 0.005 (mg/cm$^2$).

<Oil Roller 424 with respect to Second Roller 420>

The diameter is about 19 mm.

Oil is dimethyl silicon oil having viscosity (cst) of about 1000.

The quantity of oil which is applied to the surface of the second roller 420 is about 0.0005 (mg/cm$^2$)

Although the invention has been described in its preferred form with a certain degree of particularity, it is understood that the present disclosure of the preferred form can be changed in the details of construction and in the combination and arrangement of parts without departing from the spirit and the scope of the invention as defined in the appended claims.

For example, (1) An above-mentioned embodiment has a structure such that only the double-side mode/single-side mode can be selected by operating the mode selection switch 84. Thus alternatively, the inverse and re-fixing sub-mode may be permitted to be selected. When the inverse and re-fixing sub-mode is selected, the inverse and re-fixing operation is then performed regardless of the type of the recording medium.

(2) An above-mentioned embodiment is provided with the paper selection switch 85 and the image-quality selection switch 86. In an alternative arranged, only one of the above-mentioned switches 85, 86 may be provided for switching the mode. When, for example, plain paper is selected by operating the paper selection switch 85, the usual single-side mode is automatically started so that a matted image is formed. When an OHP sheet or the like (glossy paper, a lustered film or paper for only a color image) is selected, the inverse and re-fixing sub-mode is automatically started so that a glossy image is formed.

(3) An above-mentioned embodiment has a structure in which the recording medium is allowed to pass through the fixing unit two times in the inverse and re-fixing sub-mode. However, the number of times may be four or more by repeating the operation for inverting and re-fixing the recording medium. The recording medium may thus be allowed to pass through the fixing unit an odd number of times in the inverse and re-fixing sub-mode.

(4) The inlet detection means for detecting when the trailing end of a recording medium has passed through the inlet portion of the paper-discharge passage 93 may comprise various different structures. For example, the means may comprise the photosensor 82*a* or 82*b* constituting the clogging detection means. That is, if the size of the recording medium is detected, the foregoing photosensors may be employed to detect the trailing end of the recording medium in accordance with the elapsed time after detection of the leading end of the recording medium.

(5) The fixing pressure for the second and following fixing operations may be raised or the fixing temperature may be raised in the inverse and re-fixing sub-mode.

(6) Although the discharge passage for discharging recording mediums in the single-side mode is the second paper-discharge passage 93*b* when the state is a normal state, the foregoing discharge passage may be the first paper-discharge passage 93*a*. When clogging has taken place, the following recording mediums may then be introduced into the second paper-discharge passage 93*b*.

What is claimed is:

1. An image forming apparatus comprising:

an image forming portion for forming a non-fixed image on a recording medium;

a fixing unit having first and second rollers, each having a surface layer, arranged to fix the non-fixed image to the recording medium by conveying the recording medium while heating and applying pressure to the recording medium, a double-side mode for forming images on both sides of the recording medium; and a single-side mode for forming an image on either side of the recording medium, wherein said single-side mode has a selection-permitted inverse and re-fixing sub-mode in which a recording medium allowed to pass through said fixing unit a first time is again allowed to pass through said fixing unit at least one more time such that the recording medium is turned inside out, and said first roller is brought into contact with the non-fixed image on the recording medium when the recording medium is allowed to pass through said fixing unit the first time, said second roller is brought into contact with the image on the recording medium when the recording medium is allowed to pass through said fixing unit at said at least one more time and the hardness of the surface layer of said second roller is larger than that of the surface layer of said first roller.

2. An image forming apparatus according to claim 1, wherein the surface layer of said second roller is made of resin having a releasing characteristic.

3. An image forming apparatus according to claim 1, wherein the temperature of the surface of said second roller is higher than the temperature of the surface of said first roller.

4. An image forming apparatus according to claim 1, wherein said inverse and re-fixing sub-mode is a mode in which the recording medium is allowed to pass through said fixing unit an even number of times, and the shape of a nipping portion between said first and second rollers is recessed towards said second roller when the recess is viewed from the axial direction of the nipping portion.

5. An image forming apparatus according to clam 1, further comprising means for selecting a type of recording medium, wherein said inverse and re-fixing sub-mode is selected in accordance with the type of the recording medium.

6. An image forming apparatus according to claim 1, further comprising an inverting and returning passage for turning inside out the recording medium allowed to pass through said fixing unit one time in said double-side mode and for again returning the recording medium to said image forming portion, wherein said inverting and returning passage is employed as a passage through which the recording medium is turned inside out and again returned to said fixing unit in said inverse and re-fixing sub-mode.

7. An image forming apparatus according to claim 6, wherein said inverting and returning passage has a length sufficient to accommodate a plurality of recording mediums.

8. An image forming apparatus according to claim 1, further comprising means for selecting either a matted or glossy image type, wherein said inverse and re-fixing sub-mode is automatically selected in accordance with the image type.

9. An image forming apparatus comprising:

an image forming portion for forming a non-fixed image on a recording medium;

a fixing unit for fixing the non-fixed image to the recording medium by conveying the recording medium while heating and applying pressure to the recording medium;

a double-side mode for forming images on both sides of the recording medium; and a single-side mode for forming an image on either side of the recording medium, wherein said single-side mode has a selection-permitted inverse and re-fixing sub-mode in which a recording medium allowed to pass through said fixing unit one time is again allowed to pass through said fixing unit at least one more time such that the recording medium is turned inside out, wherein said inverse and re-fixing sub-mode is selectively operable and further comprising means for selecting a type of recording medium wherein said inverse and re-fixing sub-mode is automatically selected in accordance with the type of recording medium selected.

10. An image forming apparatus according to claim 9, further comprising means for selecting either a matted or glossy image type, wherein said inverse and re-fixing sub-mode is automatically selected in accordance with the image type selected.

11. An image forming apparatus according to claim 9, further comprising an inverting and returning passage for turning inside out the recording medium allowed to pass through said fixing unit one time in said double-side mode and for again returning the recording medium to said image forming portion, wherein said inverting and returning passage is employed as a passage through which the recording medium is turned inside out and again returned to said fixing unit in said inverse and re-fixing sub-mode.

12. An image forming apparatus according to claim 11, wherein said inverting and returning passage has a length sufficient to accommodate a plurality of recording mediums.

13. An image forming apparatus comprising:

an image forming portion for forming a non-fixed image on a recording medium;

a fixing unit having first and second rollers arranged to fix the non-fixed image to the recording medium by conveying the recording medium while heating and applying pressure to the recording medium;

a double-side mode for forming images on both sides of the recording medium; and a single-side mode for forming an image on either side of the recording medium, wherein said single-side mode has a selection-permitted inverse and re-fixing sub-mode in which a recording medium allowed to pass through said fixing unit one time is again allowed to pass through said fixing unit at least one more time such that the recording medium is turned inside out, and a nipping portion, between said first and second rollers, formed into a recess, which when viewed from an axial direction, faces a roller which is brought into contact with an image forming surface of the recording medium which is allowed to finally pass through said fixing unit in said inverse and re-fixing sub-mode.

14. An image forming apparatus according to claim 13, further comprising means for selecting a type of recording medium wherein said inverse and re-fixing sub-mode is automatically selected in accordance with the type of recording medium selected.

15. An image forming apparatus according to claim 13, further comprising means for selecting either a matted or glossy image type, wherein said inverse and re-fixing sub-mode is automatically selected in accordance with the selected type.

16. An image forming apparatus according to claim 13, further comprising an inverting and returning passage for turning inside out the recording medium allowed to pass through said fixing unit one time in said double-side mode and for again returning the recording medium to said image forming portion, wherein said inverting and returning passage is employed as a passage through which the recording medium is turned inside out and is again returned to said fixing unit in said inverse and re-fixing sub-mode.

17. An image forming apparatus according to claim 16, wherein said inverting and returning passage has a length sufficient to accommodate a plurality of recording mediums.

18. An image forming apparatus comprising:

a fixing unit for conveying a recording medium while heating and applying pressure to the recording medium;

means for conveying a recording medium, having a non-fixed image formed on the surface thereof through said fixing unit a plurality of times so as to fix the image to the recording medium;

and means for varying the speed of conveyance such that said recording medium is conveyed through said fixing unit a first time at a first speed and is conveyed by said fixing unit during second and following conveying operations at a speed which is lower than said first conveying speed.

19. An image forming apparatus according to claim 18, wherein said means for conveying the recording medium through said fixing unit a plurality of times further includes means for conveying the recording medium through said fixing unit one time, and then for turning the recording medium inside out at the second and following conveying operations.

20. An image forming apparatus according to claim 18, further comprising first and second rollers for conveying the recording medium while heating and applying pressure to the recording medium, wherein the shape of a nipping portion between said first and second rollers is formed into a recess, which when viewed from an axial direction, faces the roller which is brought into contact with an image formed on one surface of the recording medium that is allowed to finally pass through said fixing unit.

21. An image forming apparatus comprising:

an image forming portion for forming a non-fixed image on a recording medium;

a fixing unit having first and second rollers arranged to fix the non-fixed image to the recording medium by conveying the recording medium while heating and applying pressure to the recording medium;

a double-side mode for forming images on both sides of the recording medium; and a single-side mode for forming an image on either side of the recording medium, wherein said single-side mode has a selection-permitted inverse and re-fixing sub-mode in which a recording medium allowed to pass through said fixing unit a first time is again allowed to pass through said fixing unit at least one more time such that the recording medium is turned inside out, and said first roller is brought into contact with the non-fixed image on the recording medium when the recording medium is allowed to pass through said fixing unit a first time, said second roller is brought into contact with the image on the recording medium when the recording medium is allowed to pass through said fixing unit said at least one more time, and the temperature of the surface of said second roller is higher than the temperature of the surface of said first roller.

22. An image forming apparatus according to claim 21, wherein said inverse and re-fixing sub-mode is a mode in which the recording medium is allowed to pass through the fixing unit an even number of times, and the shape of a nipping portion between said first and second rollers is recess towards said second roller when the recess is viewed from the axial direction of the nipping portion.

23. An image forming apparatus according to claim 21, further comprising means for selecting a type of recording medium wherein said inverse and re-fixing sub-mode is automatically selected in accordance with the type of recording medium selected.

24. An image forming apparatus according to claim 21, further comprising means for selecting either a matted or glossy image type, wherein said inverse and re-fixing sub-mode is automatically selected in accordance with the image type.

25. An image forming apparatus according to claim 21, further comprising an inverting and returning passage for turning inside out the recording medium allowed to pass through said fixing unit one time in said double-side mode and for again returning the recording medium to said image forming portion, wherein said inverting and returning passage is employed as a passage through which the recording medium is turned inside out and again returned to said fixing unit in said inverse and re-fixing sub-mode.

26. An image forming apparatus according to claim 21, wherein said inverting and returning passage has a length sufficient to accommodate a plurality of recording mediums.

* * * * *